US008251249B1

(12) United States Patent
Vovan

(10) Patent No.: US 8,251,249 B1
(45) Date of Patent: Aug. 28, 2012

(54) HANGABLE TAMPER RESISTANT PACKAGING SYSTEM

(75) Inventor: Terry Vovan, Upland, CA (US)

(73) Assignee: PWP Industries, Vernon, CA (US)

( * ) Notice: Subject to any disclaimer, the term of this patent is extended or adjusted under 35 U.S.C. 154(b) by 705 days.

(21) Appl. No.: 12/371,888

(22) Filed: Feb. 16, 2009

Related U.S. Application Data

(63) Continuation-in-part of application No. 11/496,215, filed on Jul. 31, 2006, now Pat. No. 7,568,589, which is a continuation-in-part of application No. 11/166,308, filed on Jun. 24, 2005, now abandoned.

(60) Provisional application No. 61/065,907, filed on Feb. 15, 2008.

(51) Int. Cl.
*B65D 21/02* (2006.01)

(52) U.S. Cl. ..... 220/791; 220/4.21; 220/4.22; 220/4.24; 220/4.26; 220/4.27; 220/23.83; 220/23.86; 220/377; 220/500; 220/520; 220/521; 220/523; 220/751; 220/752; 220/767; 220/796; 220/826; 220/836; 220/840; 206/228; 206/369; 206/461

(58) Field of Classification Search ..... 220/4.21, 220/4.22, 4.24, 4.26, 4.27, 23.83, 377, 791, 220/826, 836; 206/369, 461
See application file for complete search history.

(56) References Cited

U.S. PATENT DOCUMENTS

| | | | |
|---|---|---|---|
| 3,572,579 | A | 3/1971 | Mueller |
| 3,773,207 | A | 11/1973 | Dokoupil et al. |
| 4,006,839 | A | 2/1977 | Thiel et al. |
| 4,091,930 | A | 5/1978 | Buchner et al. |
| 4,113,136 | A | 9/1978 | Abbott |
| 4,433,793 | A | 2/1984 | Ingemann |
| 4,434,907 | A | 3/1984 | Ingemann |
| 4,535,889 | A | 8/1985 | Terauds |
| 4,627,550 | A | 12/1986 | Dines |
| 4,742,935 | A | 5/1988 | Schellenberg |
| 4,759,463 | A | 7/1988 | Mazoin |
| 4,765,463 | A | 8/1988 | Chanel |
| 4,881,656 | A | 11/1989 | Chumley et al. |
| 4,890,758 | A | 1/1990 | Gailus |
| 4,930,656 | A | 6/1990 | Blanchette |

(Continued)

FOREIGN PATENT DOCUMENTS

| | | |
|---|---|---|
| DE | 7816353 | 11/1978 |

(Continued)

OTHER PUBLICATIONS

U.S. Appl. No. 12/321,254, filed Jan. 20, 2009.

(Continued)

*Primary Examiner* — Anthony Stashick
*Assistant Examiner* — Elizabeth Volz
(74) *Attorney, Agent, or Firm* — Baker Botts L.L.P.

(57) ABSTRACT

A clam-shell container system can include first and second container pieces that are hingedly connected. The first container piece can include a perimeter and a hangable tab, the hangable tab having an opening configured to receive a rod. The hinge connection can be perforated, such that it breaks upon actuation of the hangable tab to open the container system. The second container piece can include a cutout in proximity to the hinge connection and the hangable tab. Accordingly, the cutout can provide clearance for the rotation of the hangable tab beyond the hinge connection. Further, the second container piece can have a perimeter having a shape substantially similar to the perimeter of the first container piece. The perimeters can form a substantial seal in combination.

24 Claims, 23 Drawing Sheets

U.S. PATENT DOCUMENTS

| | | | |
|---|---|---|---|
| 4,966,292 | A | 10/1990 | Marino |
| 4,998,622 | A | 3/1991 | Drack |
| 5,002,198 | A | 3/1991 | Smith |
| 5,007,231 | A | 4/1991 | Ingemann |
| 5,027,969 | A | 7/1991 | Lesquir |
| 5,040,695 | A | 8/1991 | Adams et al. |
| 5,052,574 | A | 10/1991 | McKinnon et al. |
| 5,111,953 | A | 5/1992 | Faust et al. |
| 5,111,954 | A | 5/1992 | Gaudreault |
| 5,115,934 | A | 5/1992 | Nelson |
| 5,129,531 | A | 7/1992 | Beck et al. |
| 5,133,470 | A | 7/1992 | Abrams et al. |
| 5,170,905 | A | 12/1992 | Luch |
| 5,219,074 | A | 6/1993 | Mizuno et al. |
| 5,219,087 | A | 6/1993 | Christennson |
| 5,249,694 | A | 10/1993 | Nelson |
| 5,287,959 | A | 2/1994 | Hansen et al. |
| 5,307,948 | A | 5/1994 | Blackburn et al. |
| D352,000 | S | 11/1994 | Hansen et al. |
| 5,421,473 | A | 6/1995 | McCrossen |
| 5,507,405 | A | 4/1996 | Thomas et al. |
| 5,507,406 | A | 4/1996 | Urciuoli et al. |
| 5,511,679 | A | 4/1996 | Beck |
| 5,528,814 | A | 6/1996 | Luch et al. |
| 5,545,375 | A | 8/1996 | Tropsha et al. |
| 5,573,134 | A | 11/1996 | Chenault et al. |
| 5,607,075 | A | 3/1997 | Burgdorf et al. |
| 5,683,771 | A | 11/1997 | Tropsha |
| 5,842,593 | A | 12/1998 | von Holdt |
| 5,875,913 | A | 3/1999 | Letica |
| 5,897,011 | A | 4/1999 | Brilliant et al. |
| 5,931,332 | A | 8/1999 | Mygatt et al. |
| 5,979,690 | A | 11/1999 | Hartley |
| 6,000,570 | A | 12/1999 | Nelson |
| RE36,729 | E | 6/2000 | Luch et al. |
| 6,116,501 | A | 9/2000 | Hupp |
| 6,135,304 | A | 10/2000 | Wyslotsky |
| 6,168,044 | B1 | 1/2001 | Zettle et al. |
| 6,257,435 | B1 | 7/2001 | Chedister et al. |
| 6,279,774 | B1 | 8/2001 | Clute et al. |
| 6,564,958 | B1 | 5/2003 | Ramsey et al. |
| 6,572,909 | B1 | 6/2003 | Bagwell et al. |
| 6,604,645 | B1 | 8/2003 | Vaupotic |
| 6,772,901 | B2 | 8/2004 | Witt |
| 6,926,165 | B2 | 8/2005 | Conti |
| 7,004,341 | B2 | 2/2006 | Shenkar et al. |
| 7,073,680 | B2 | 7/2006 | Boback et al. |
| 7,097,058 | B2 | 8/2006 | Wellman et al. |
| 7,118,003 | B2 | 10/2006 | Sellari et al. |
| 7,207,457 | B2 | 4/2007 | Schwarz |
| 7,243,813 | B2 | 7/2007 | Krueger |
| 7,311,218 | B2 | 12/2007 | Varadarajan |
| 2003/0052133 | A1 | 3/2003 | Hayes et al. |
| 2003/0160051 | A1 | 8/2003 | Ciccone |
| 2004/0134910 | A1 | 7/2004 | Colombo |
| 2006/0060578 | A1 | 3/2006 | Church et al. |
| 2006/0163265 | A1 | 7/2006 | De Candido |
| 2006/0201946 | A1 | 9/2006 | Witt |
| 2006/0255054 | A1 | 11/2006 | Vovan |
| 2006/0261070 | A1 | 11/2006 | Robertson et al. |
| 2006/0266750 | A1 | 11/2006 | Lesquir |
| 2006/0278652 | A1 | 12/2006 | Vovan et al. |
| 2006/0289541 | A1 | 12/2006 | Boback et al. |
| 2006/0289549 | A1 | 12/2006 | Vovan |
| 2007/0012710 | A1 | 1/2007 | Vovan |
| 2007/0062948 | A1 | 3/2007 | Albrecht et al. |
| 2007/0108210 | A1 | 5/2007 | Alvares et al. |
| 2007/0138046 | A1 | 6/2007 | Vovan |
| 2007/0138180 | A1 | 6/2007 | Vovan |
| 2007/0196541 | A1 | 8/2007 | Vovan et al. |
| 2007/0202221 | A1 | 8/2007 | Hinze et al. |
| 2008/0000904 | A1 | 1/2008 | Vovan |
| 2008/0006632 | A1 | 1/2008 | Vovan |
| 2008/0185383 | A1 | 8/2008 | Philippe et al. |
| 2009/0021026 | A1 | 1/2009 | Collier |
| 2009/0057313 | A1 | 3/2009 | Alvares |
| 2009/0206082 | A1 | 8/2009 | Vovan |

FOREIGN PATENT DOCUMENTS

| | | | |
|---|---|---|---|
| DE | 4418935 | | 12/1995 |
| DE | 29914659 | U1 | 8/1999 |
| DE | 1999083197 | | 8/1999 |
| EP | 0752374 | | 1/1997 |
| FR | 2691952 | A1 | 6/1992 |
| FR | 2819496 | A1 | 1/2001 |
| GB | 2257118 | | 1/1993 |
| WO | WO 2005/009857 | A | 2/2005 |

OTHER PUBLICATIONS

U.S. Appl. No. 12/321,254, Non-Final Rejection dated Oct. 26, 2010.
U.S. Appl. No. 12/321,254, Amendment dated Jan. 26, 2011.
U.S. Appl. No. 12/321,254, Notice of Allowance dated Apr. 5, 2011.
U.S. Appl. No. 11/496,215, Nov. 12, 2008 Requirement for Restriction.
U.S. Appl. No. 11/496,215, Dec. 4, 2008 Response to Restriction.
U.S. Appl. No. 11/496,215, Feb. 10, 2009 Non-Final office Action.
U.S. Appl. No. 11/496,215, Mar. 2, 2009 Resposne to Non-Final Office Action.
U.S. Appl. No. 11/496,215, Jun. 1, 2009 Notice of Allowance.
U.S. Appl. No. 11/496,215, Jun. 24, 2009 Supplemental Notice of Allowance.
U.S. Appl. No. 12/512,817, Oct. 21, 2009 Examiner Interview Summary.
U.S. Appl. No. 12/512,817, Nov. 23, 2009 Preliminary Amendment.
U.S. Appl. No. 12/512,817, Nov. 23, 2009 Applicant Interview Summary.
U.S. Appl. No. 12/512,817, Mar. 15, 2010 Notice of Allowance.
U.S. Appl. No. 12/512,817, Mar. 23, 2010 Terminal Disclaimer.
*Food container* purportedly published in Apr. 2005.
*Safer Sandwiches*, www.packagingtoday.co.uk—Packaging Today, purportedly published in Apr. 2005.
*Tamper Evident Container*, dated Sep. 13, 2004 and purportedly exhibited in a foreign country in Apr. 2005.
*Tri-Star to Unveil First Ever Tamper Evident Salad Containers at Total Sandwich Show*, Sandwich and Snack News, purportedly published in Apr. 2005.
U.S. Appl. No. 12/200,670, filed Aug. 28, 2008, Inventor Vovan, Title "Tamper-Evident Food Packaging".

HANGABLE TAMPER RESISTANT PACKAGING SYSTEM

CROSS-REFERENCE TO RELATED APPLICATIONS

This application is a continuation-in-part of U.S. patent application Ser. No. 11/496,215 (filed Jul. 31, 2006), which is a continuation-in-part of U.S. patent application Ser. No. 11/166,308 (filed Jun. 24, 2005), and this application also claims the priority benefit under 35 U.S.C. §119(e) to U.S. Provisional Patent Application Ser. No. 61/065,907 (filed Feb. 15, 2008); the entirety of these applications are hereby expressly incorporated by reference herein.

BACKGROUND

1. Field of the Invention

The present invention relates to tamper resistant hangable containers and, more particularly, to hangable deli packs.

2. Description of the Related Art

Food is often placed in a transparent plastic container that includes a base with a large volume cavity that holds the food and with a cover or lid that closes the cavity. Buyers want to be assured that, after the food was placed in the container as by a clerk at the food store, that the container has not been opened. There is a possibility that another customer has secretly opened the container enough to taste a bit of food before closing it (possibly leaving germs from his/her finger in the food). Potential buyers want to be assured that this has not happened. A container that could be constructed at low cost from plastic, that could be easily initially closed by a clerk at a store after loading goods such as food into the container, and which thereafter required a customer to tear apart parts of the container before initially opening it, would be of value.

Retailers frequently display items for sale on hangers, allowing the products to be hung in rows. Consumers interested in purchasing the products can easily remove one or more items from the hanger. Such methods of distribution can be advantageous in the context of deli meats, cheeses, confectionery, baked goods, produce, hardware, and other products, as they can be hung on dispensing rods. A product at the front of the row can be visible to the consumer, while the remaining items lie behind, coming to the forefront when the first item is removed. Accordingly, if each row has a distinct hanger, then a consumer can simultaneously see precisely one of each product, maximizing the visible selection while maintaining a relative compactness of product within the display area.

Prior art deli packs include a firm cardboard backing including a hole for a hook, and a plastic covering typically glued or welded to the cardboard backing to hold the product. This design does not lend itself to resealing or reclosing, as once the package is opened it substantially loses its ability to reliably hold its contents.

SUMMARY OF THE INVENTION

One object of the containers described herein is to provide a superior hangable packaging. As discussed further herein, in some embodiments the container can be both hangable and resealable, allowing for preservation of its contents long after an initial opening of the package. Further, in some embodiments, the hanging features can be integrated with the remainder of the packaging, providing a sleek and compact design. The disclosure herein provides for a unique approach that can achieve these objectives, among others.

In accordance with one embodiment of the invention, a container is provided that can be constructed at low cost, that can be loaded with goods and initially closed by a clerk at a store and hung on a conventional store hanger, and that thereafter requires a customer to manipulate the container when initially opening it, in a manner that makes it clear that the container was initially opened. The container is constructed of plastic, and preferably of a sheet of plastic that has been formed into the shape of a base having an upwardly-opening cavity for holding goods, and a lid that can close the cavity. The base and lid initially have adjacent first sides and widely-spaced second sides. The first sides are joined by a join line in the plastic sheet that can be easily torn. At the join line, the base and lid have been bent and the bend has been creased, so rim portions of the base and lid lie facewise adjacent to each other. A bump is formed in one of the rim portions to slightly separate the base and lid rim portions once the join line has been torn, indicating that the container has been previously opened.

A clerk loads food into the cavity of the base, and moves the second sides of the container together so they latch together. The second sides latch together to close the container, in a manner that prevents their initial separation. With the second sides of the base and lid latched together and the first sides joined along a join line that must be torn to separate the first sides, the container is securely initially closed. In this condition, the goods in the container cannot be readily touched or sampled by a customer. For a buyer of the container to initially open the container, the buyer must tear apart the first sides of the base and lid along the join line. The join line is weakened, as by a series of slits, so it can be more easily torn apart.

The first sides of the base and lid are formed with a tab in the lid that can be pulled up to tear the join line while the base is held down. The base can be held down by a person grasping a base tab that is horizontally spaced from the lid tab. The outer end of the lid tab, which lies furthest from the container vertical axis, is formed out of material in a flat rim of the first side of the base, to thereby leave a cutout in the base under the lid tab.

In one embodiment, a clam-shell container system can include first and second container pieces that are hingedly connected. The first container piece can include a perimeter and a hangable tab, the hangable tab having an opening configured to receive a prong, rod, hanging rod, or rack. The hinge connection can be perforated, such that it breaks upon actuation of the hangable tab to open the container system. The second container piece can include a cutout in proximity to the hinge connection and the hangable tab. Accordingly, the cutout can provide clearance for the rotation of the hangable tab beyond the hinge connection. Further, the second container piece can have a perimeter having a shape substantially similar to the perimeter of the first container piece. The perimeters can form a substantial seal in combination.

In another embodiment a method for forming a container system can be provided. A thermoplastic sheet can be formed into a lid and base connected by a strip of material at their ends. The strip can be cut to form a tab on the lid and a complementary cutout on the base without removing material. The strip can also be perforated to form a perforated line from the edge of the strip to the base of the tab.

In a further embodiment, a container system can include a lid and a base. The lid can include a snap-fitting tab. The base can be hingedly connected to the lid and include a tab as well. The bas can additionally include a snap-fitting receiver mounted on the tab. The snap-fitting receiver can form a snap-fit with the snap-fitting tab. The base can also include a pull portion at the end of the tab and adjacent the snap-fitting receiver, such that pulling on the pull portion can cause the snap-fit to release. Finally, the base can include a perforated line adjacent the pull portion and configured to tear upon actuation of the pull portion.

In yet another embodiment a container system can include two compartments. The first compartment can include a first lid hingedly connected to a first base. The first lid can include a lift tab and the first base can include a tab slot positioned to receive the lift tab when the first compartment is in a closed position. The second compartment can be adjacent and connected to the first compartment, and include a hingedly connected second lid and second base. The second lid can include a second tab positioned to obscure the tab slot when the second compartment is in a closed position. The second base can include a third tab positioned and configured to form an interlocking means with the first tab when the second compartment is in a closed position.

In yet another embodiment a dual-compartment container system can include two lids and two bases hingedly connected to the lids. The lids can include hangable tabs and the hinge connections can be perforated such that they break upon actuation of the hangable tabs to open the compartments. The bases can include a cutout in proximity to the hinge connection and the hangable tab, providing clearance for the rotation of the hangable tab beyond the hinge connection. Further, the two bases can be hingedly connected to each other such that they can be folded into a face-to-face position.

BRIEF DESCRIPTION OF THE DRAWINGS

The following drawings and the associated descriptions are provided to illustrate embodiments of the present disclosure and do not limit the scope of the disclosure or claims.

DETAILED DESCRIPTION OF THE PREFERRED EMBODIMENTS

Figure 1:
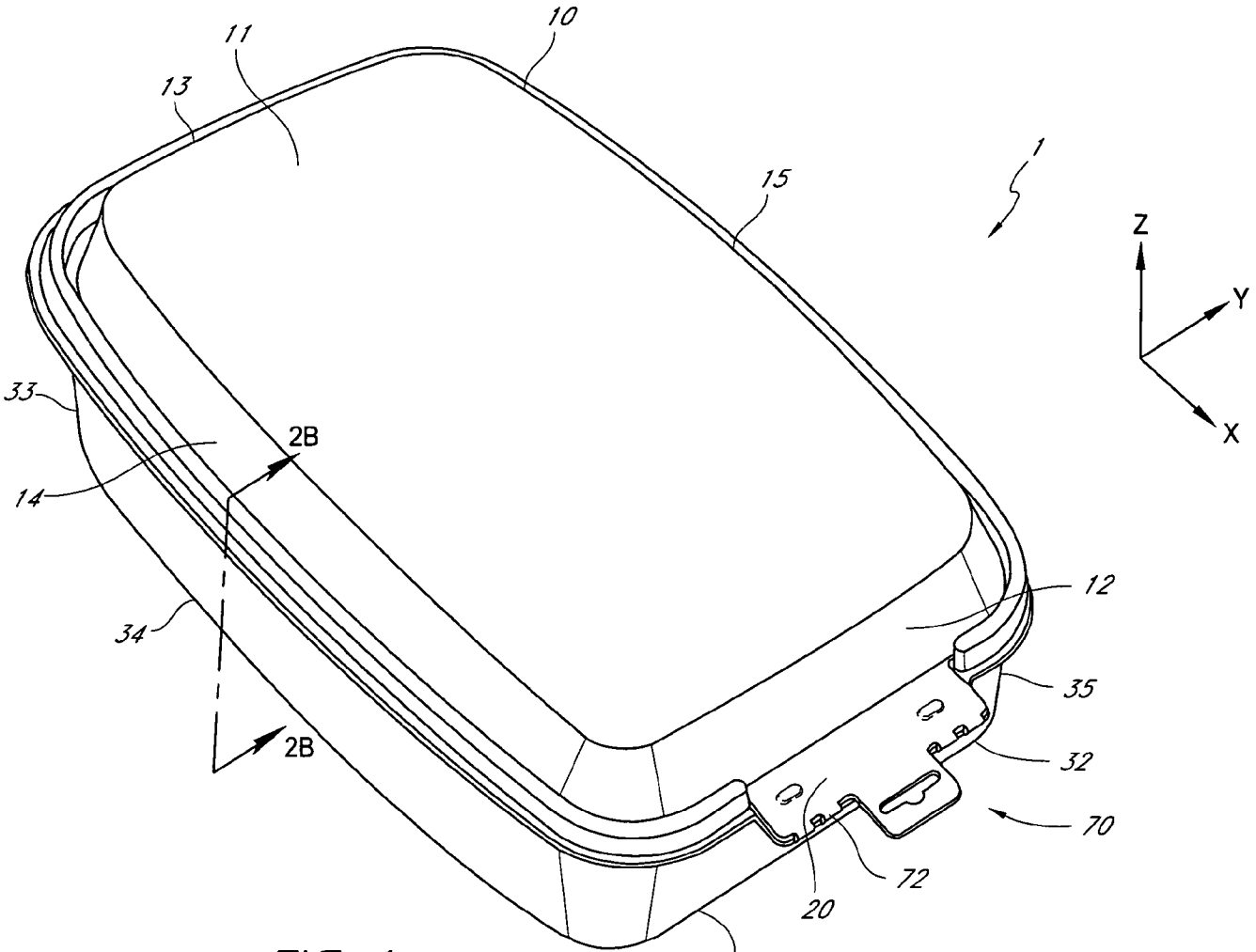
FIG. 1 is an isometric view of an embodiment container system in a closed position.

To assist in the description of these components, the following coordinate terms are used. FIG. 1 depicts an x-y-z Cartesian coordinate system, with the container system primarily lying in the x-y plane. As described herein, terms such as "height" refer to distance in the z-direction, and "higher/upward" and "lower/downward" refer to the positive and negative z-direction, respectively. Similarly, terms such as "outward", "inward", and "radial" generally refer to directions in the x-y plane directed generally away from or toward the center of the container system, although not necessarily directly from or toward the center. Similarly, terms such as "lateral" will refer to the y-direction and "longitudinal" will refer to the x-direction. A detailed description of a preferred embodiment of the container system, and its associated method of use, now follows.

Figure 2:
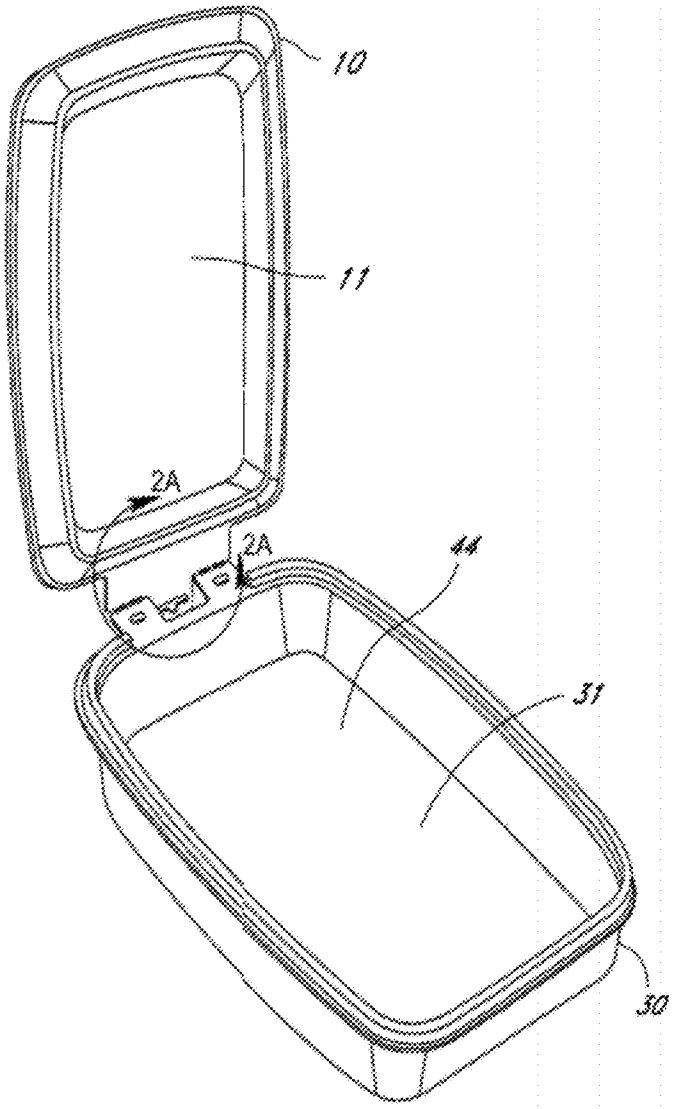
FIG. 2 is an isometric view of the container system of FIG. 1 in a half-open position.
Figure 3:
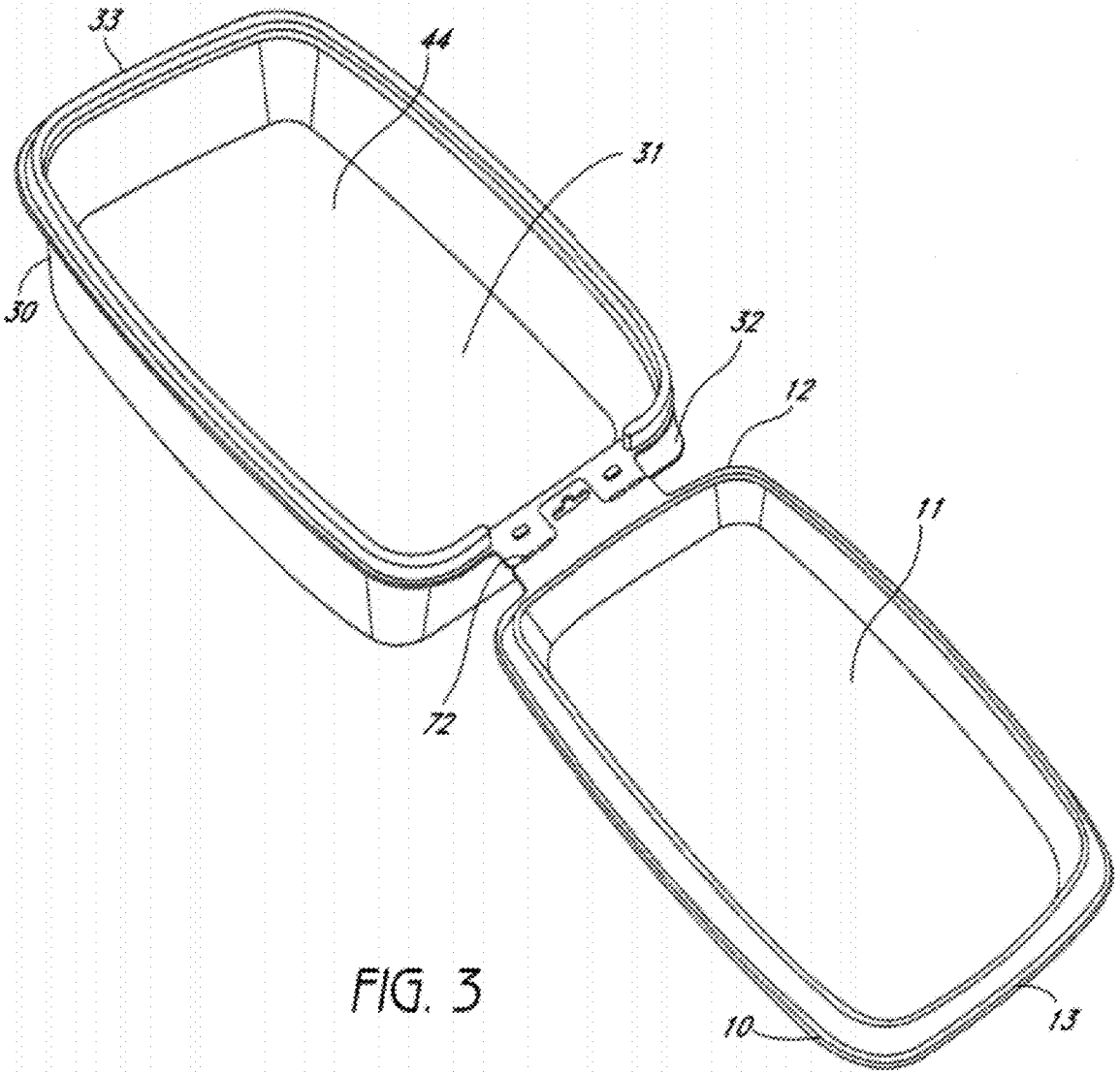
FIG. 3 is an isometric view of the container system of FIG. 1 in an open position.

FIGS. 1-3 illustrate an embodiment container system 1 including a base 30 with an upwardly-opening cavity 44 for holding goods such as food, and a lid 10 that closes the top of the cavity. The base 30 and lid 10 are preferably formed of a single sheet of plastic that has been thermoformed as by vacuum forming, transfer molding or blow molding. It is even possible to injection mold the container to form a container comprising a plastic sheet. The base 30 and lid 10 can include center portions 11, 31 surrounded by second, third, and fourth sides 13-15, 33-35 that are securely held to each other so the sides cannot be separated until after the first sides 12, 32 have been separated. The first sides 12, 32 of the base 30 and lid 10 are initially fixed together along a pivoting join line 72 formed in an integral portion of the plastic sheet, that can be easily torn. Along the first sides 12, 32, the lid 10 has a lid tab 20 that projects radially outward with respect to the container system's vertical axis. As depicted, the container system 1 can have a generally rectangular shape in the x-y plane, with the lid tab 20 and the pivoting join line 72 on a shorter edge of the container. However, in other embodiments the container system 1 can have other geometric properties, such as being generally rounded. In some embodiments, the lid tab 20 can be no greater than 0.14 inches thick.

FIGS. 2 and 3 show the container system 1 as it can be supplied to a store. The container system 1 can initially be in an open position, such that a store clerk can load goods into the container system and initially close the container. At this point the first sides 12, 32 of the base 30 and lid 10 are joined along the pivoting join line 72, but the second sides 13, 33 are separated. The base 30 and lid 10 can have the form of thin plastic, or plastic sheeting, and in a preferred embodiment are parts of the same sheet of plastic (which may have portions of different thickness or other material properties). The join line 72 can be formed in an integral sheet of plastic. FIG. 3 shows the container as it can be initially formed from a single sheet of thermoformed plastic which has been thermoformed to the illustrated shape, and with slits cut along the join line 72. The lid can be folded, or bent 180 degrees from FIG. 3 at a hinge 70 to achieve the initially closed position of FIG. 1.

Figure 2A:
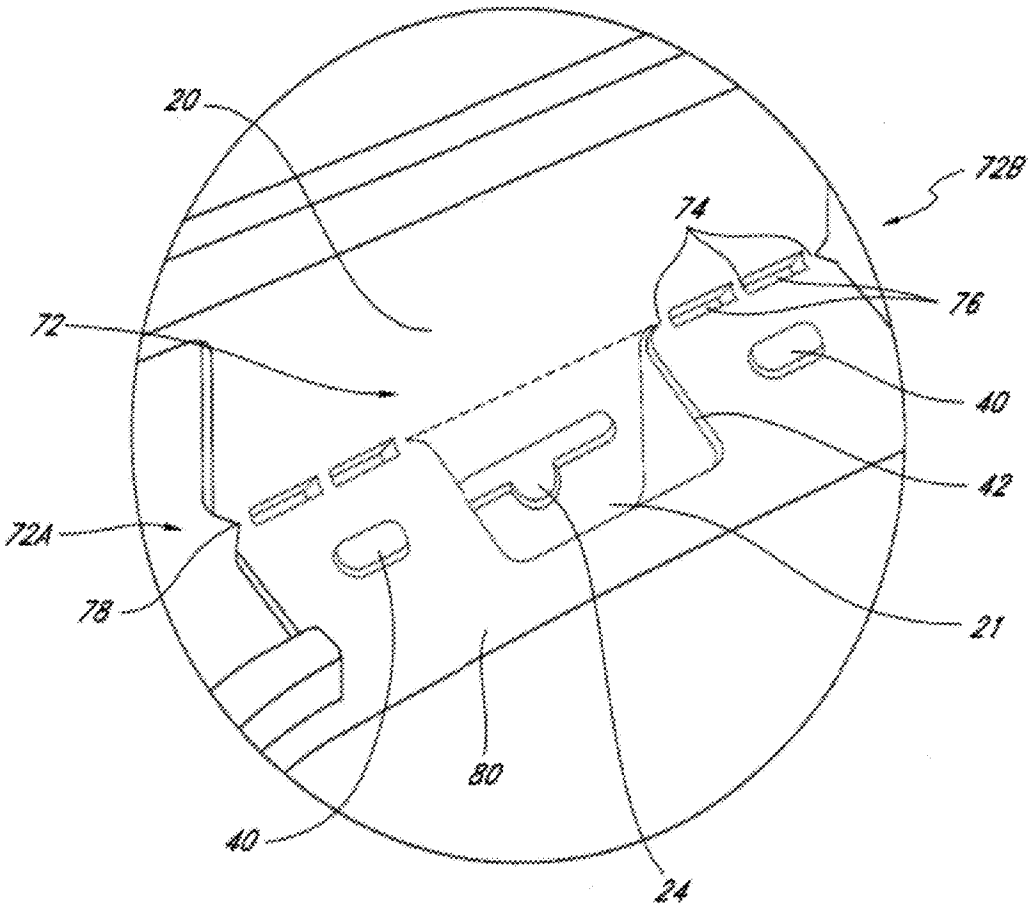
FIG. 2A is an enlarged view of the container system of FIG. 2 at 2A-2A.

FIG. 2A shows the first sides 12, 32 of the base 30 and lid 10, showing that the join line 72 includes opposite join line parts 72A and 72B that lie on opposite sides of the lid tab 20. Along each join line part 72A, 72B there are three join lengths 74 and an interrupted slit 76 with slit parts. In some embodiments, the join lengths 74 can each have a length of no more than 0.25 inch. Leading to each join line part 72A, 72B is an entrance slit 78 with an end width of the same order of magnitude as the slit 76, that leads from the tab 20 to the join line parts, to concentrate separation forces along the join line parts. In addition, the plastic sheet can be creased (by forming a sharp bend such as a bend having a radius of curvature no more than the thickness of the two sheet portions being bent) to weaken it along the join line.

It can be seen in FIG. 2A that the lid tab 20 has a radially outward extension 21 that projects beyond the pivoting join line 72 longitudinally. The base 30 can have a cutout 42 initially lying around the lid extension 21 (when the lid is pivoted 180 degrees from its closed position to the open position in which it is manufactured). As depicted, the cutout 42 can have two longitudinal walls and one lateral wall, forming a generally rectangular structure, but other shapes are possible such as a rounded cutout, a semi-circular cutout, or a generally polygonal cutout. The lid tab 20 can be formed by the cutout 42 which can extend continuously to leave a lid tab extension 21 with a generally rounded rectangular shape. The cutout 42 can leave clearance between the longitudinal and lateral cutout walls for the rotation of the lid tab 20 with no scrap plastic sheet to throw away during production of the lid tab extension 21. The tab extension 21 can end in an entrance slit 78 leading to the join line parts 72A, 72B.

In other embodiments, the base 30 can also have a tab with a similar extension. The lid can then form a cutout around the base extension (further details depicted in U.S. Patent Application Publication No. 2006/0289549, which is incorporated herein by reference in its entirety). These various structures provide longer tabs that can be more easily grasped and cutouts under or over the tabs. FIG. 2A also shows that the first side 32 of the base forms a join rim part 80 that can be flat and lie facewise adjacent to the lid tab 20 when the lid 10 is closed on the base 30. The rim part 80 of the base can also have bumps 40 that assure slight separation between the lid tab 20 and the join rim part 80 after the join line is torn.

Figure 2B:
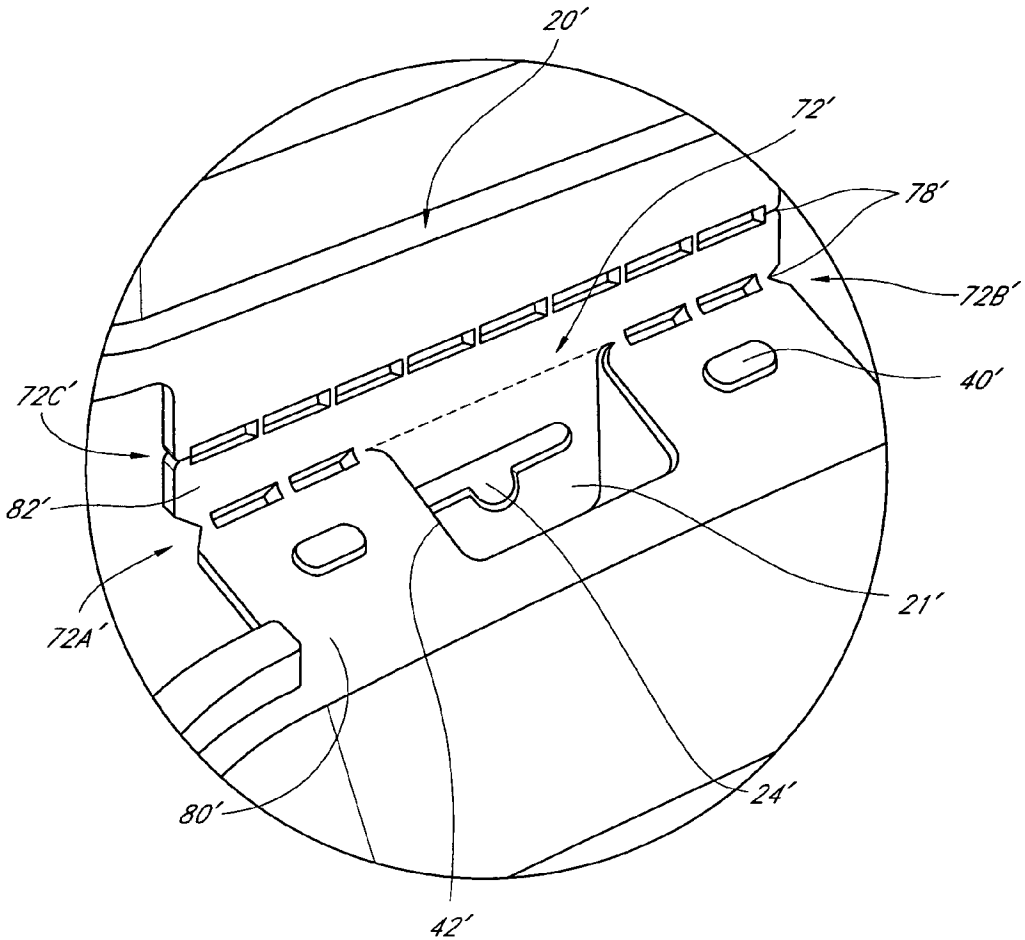
FIG. 2B is an enlarged view of another embodiment container system similar to that of FIG. 2, at 2A-2A.

FIG. 2B depicts another embodiment container system, similar to that depicted in FIG. 2A with similar features denoted with corresponding numerals. As depicted, the container system can include two join lines 72', 72C', each with entrance portions 78'. Accordingly, the first join line 72' can separate upon activation of the lid tab 20'. However, in the embodiment of FIG. 2B the second join line 72C' can remain intact after activation of the lid tab 20', retaining a removable strap 82' connecting the lid tab 20' to the lid 10'. Accordingly, this strap 82' (and the lid tab 20') can be removed at a later time, if desired, by pulling upon an edge of the strap 82' to tear the second join line 72C'. This may be desirable, for example, if a consumer has already purchased the container system and its contents, and no longer desires the hangability provided by the tab 20'. Once the tab 20' and the strap 82' have been removed, the remaining portions of the join rim part 80' on the base 30' surrounding the cutout 42' can extend beyond the lid 10', and thus function as tabs to facilitate opening and closing of the container system.

A clerk at a store can receive a stack of containers in the configuration shown in FIG. 3, with the first sides 12, 32 of the base 30 and lid 10 joined and with the second sides 13, 33 widely separated. The clerk can first load goods such as food into the cavity 44 of the base, and then pivot the lid 10 so its second side 13 lies over the base second side 33. The clerk then can force the lid second side 13 downward to lock, or latch it to the base second side 33, to place the container in an initially closed configuration. FIG. 1 shows the container in such an initially closed configuration.

Figure 2C:
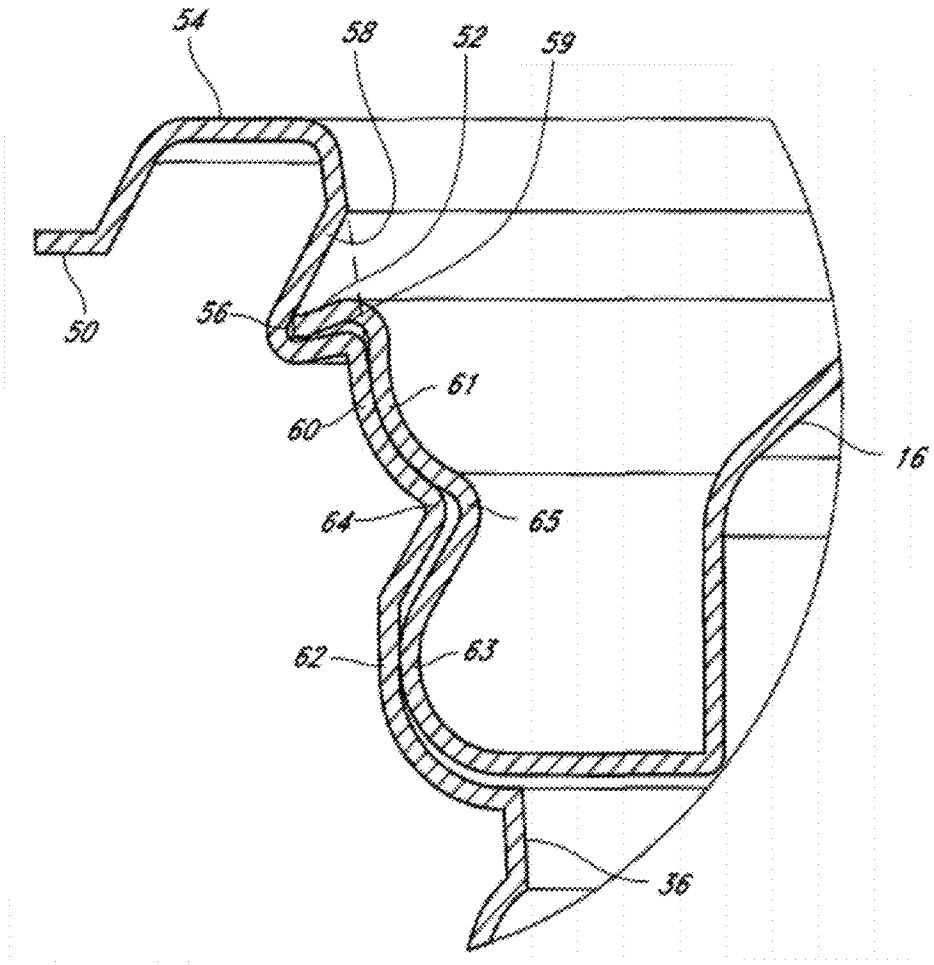
FIG. 2C is an enlarged cross-sectional view of the container system of FIG. 1 at 2B-2B.

FIG. 2C shows one embodiment interlocking structure on the third sides 14, 34 of the base 30 and lid 10 after the lid has been initially closed on the base. As depicted, the third side 34 of the base 30 has a free rim 50 with a raised ridge 54. At an inner side of the ridge 54, an undercut 58 can be formed with an upper limit surface 58 and a lower limit surface 59. The lower limit surface 59 can extend to two or more seal walls 60, 62 which can be separated by a seal ridge 64. From the lower seal wall 76, the side walls 36 of the base 30 can extend toward the center portion 31.

These features can interact with corresponding features on the lid 10. As depicted in FIG. 2C, the lid 10 can include a free rim 52. The free rim 52 can extend inward, and two seal walls 61, 63 can extend downward from the free rim, separated by a seal ridge 65 approximately matching the seal ridge 64 on the base 30.

In operation, the lid 10 and the base 30 can interengage when pressed together as depicted. When pressed together, the free rim 52 on the lid 10 and/or the undercut 56 on the base 30 can deflect to allow the free rim to enter the undercut 58. The undercut 58 can then remain between the upper and lower limit surfaces 58, 59 of the base 30. In this position, the lid 10 and the base 30 can thus be held in a facing relationship. Further, with the free rim 52 within the undercut 58, the upper and lower seal walls 60-63 can engage each other to form a substantial seal. As depicted, the form of the seal walls 60-63 and the seal ridges 64, 65 can create two sealing regions. However, in other embodiments one or more than two sealing regions can be formed. Further, although this interengagement is depicted as being on the third sides 14, 34, such sealing features can also extend about the second and fourth sides 12, 14, 32, 34, and additionally onto portions of the first sides 12, 32. Further details of such sealing features can be found, for reference, in U.S. Patent Application Publication No. 2007/0138180, which is incorporated herein in its entirety.

Advantageously, the interaction between the free rim 52 of the lid 10 and the undercut 56 of the base 30 can reversibly hold the lid and base together. As depicted in FIGS. 1, 2C, the perimeter of the lid 10 can be substantially contained by the perimeter of the base 30, preventing lateral and longitudinal movement of the lid 10 when in the closed position. Further, the free rim 52 of the lid 10, as discussed above, can be restrained vertically be the undercut 56. Accordingly, the lid 10 in the illustrated embodiment cannot be removed from the base 30 absent some deflection in the lid or base. Further, in some embodiments the interaction of the seal walls 60-63 can form a substantially liquid-tight seal within the container system 1.

Accordingly, when a clerk presses down the lid on the base during initial closing of the container, the lid can move down and deflect (as can the base along with or instead of the lid) until the free rim 52 of the lid 10 enters the undercut 56. The limit surfaces 58, 59 can then restrain the free rim 52 in its final closed position, shown in FIG. 2C.

This motion into the closed position can occur as the lid 10 rotates about the hinge 70 relative to the base 30. Although the hinge 70, as depicted and discussed herein includes a join line 72 that is perforated after formation, in other embodiments the hinge can be formed in other ways such as by sonic welding, glue, or the like. In further embodiments, the join line 72 can be unperforated. For example, to provide sufficient flexibility without perforations, in some embodiments the join line 72 can comprise a material thickness of no greater than 0.06 inches.

As depicted, there are no tabs or other projections along the lid second, third, or fourth sides 13-15 that can be grasped to pull it up. Accordingly, after a clerk initially closes the lid 10 on the base 30, a customer cannot easily open the container without tearing the plastic sheet along the pivoting join line 72, as by forcefully lifting the lid tab 20 while holding down the base (for example holding down the base by holding the ridge 54 along the base rim 38). When the customer tears the plastic sheet along the join line 72, he/she thereafter can easily close the container, and can reopen the container by lifting the lift tab 20 with a small force (e.g. less than one pound in some embodiments) as the join line has already been torn. Further, the base 30 can include bumps 40 near the join line 72 such that, after the pivoting join line 72 has been torn, the lid 10 and base 30 can be separated slightly while in the closed position to indicate to viewers that the container may have previously been opened.

In some embodiments the lid 10 can only be restrained on the second side 13. Thus, when the first side of the container is opened by lifting the lid tab, the second side of the lid can slide slightly towards the first side so the lid free rim 52 does not lie under the base shoulder and therefore the lid can be easily completely separated from the base.

Advantageously, after the clerk has closed the container system 1, the container system 1 can have a hanger hole 24 on the lid tab 20, extending outward from the container system. The container system 1 can thus hang on a standard retail hanger, or any other suitable hanging apparatus. As the entire hanging system can be created from a single sheet, this design advantageously increases the structural integrity of the container system 1. Further, provision of the tab 20 along with the cutout 42 simplifies the production of the container system 1 by reducing material that must be removed from the molded material. Integrating the tab 20 and the hanger hole 24 further reduces the number of protrusions from the container system 1, simplifying the design. Providing even further advantages, the container system 1 can have elements indicating freshness, and be resealable after an initial opening.

Figure 4B:
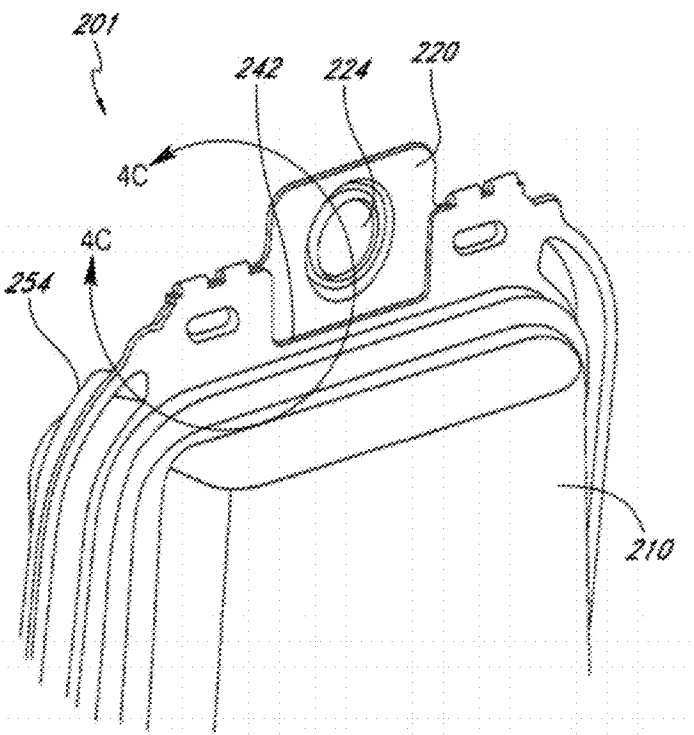
FIG. 4B is an isometric back view of the container system of FIG. 4A.
Figure 4A:
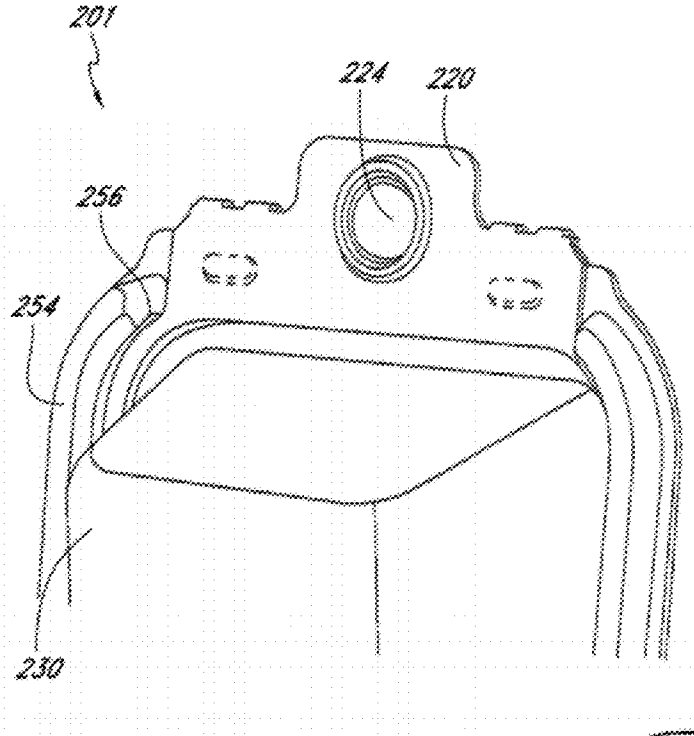
FIG. 4A is an isometric front view of another embodiment container system in a closed position.
Figure 4C:
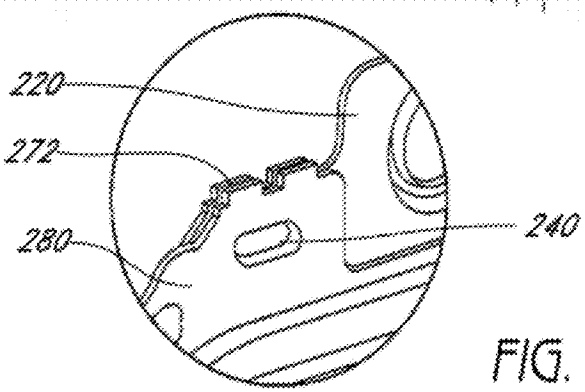
FIG. 4C is an enlarged view of the container system of FIG. 4A at 4C-4C.

FIGS. 4A-C depict another embodiment container system 201. As depicted, the container system 201 can include a base 230 and a lid 210, with a base tab 220 on the base and a cutout 242. The base tab 220 can have a circular hanger hole 224. As further depicted, the perimeter sealing between the lid 210 and the base 230 can be substantially the reverse of the sealing between the lid 10 and the base 30 in the embodiment of FIGS. 1-3. The lid 210 can include a ridge 254 with an undercut 256, and the base 230 can include a free rim (not shown) extending into the undercut. As depicted in FIG. 4C, once a perforated join line 272 has been broken, it can be visible to a viewer, with the separation between the base tab 220 and the join rim part 280 on the lid 210 amplified by the bumps 240

Figure 5B:
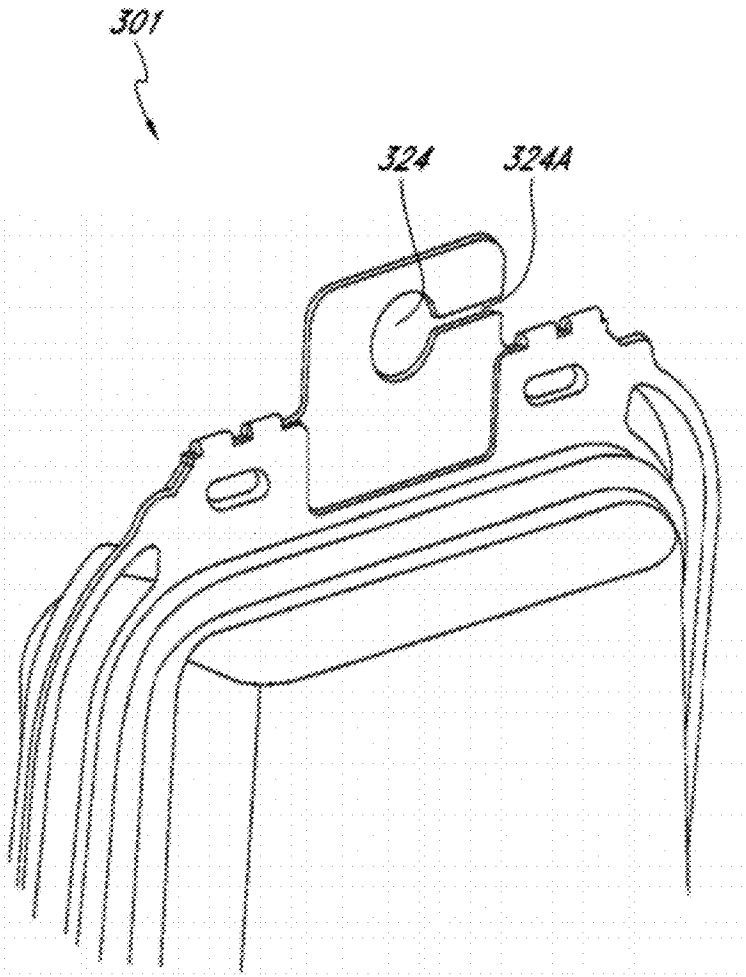
FIG. 5B is an isometric back view of the container system of FIG. 5A.
Figure 5A:
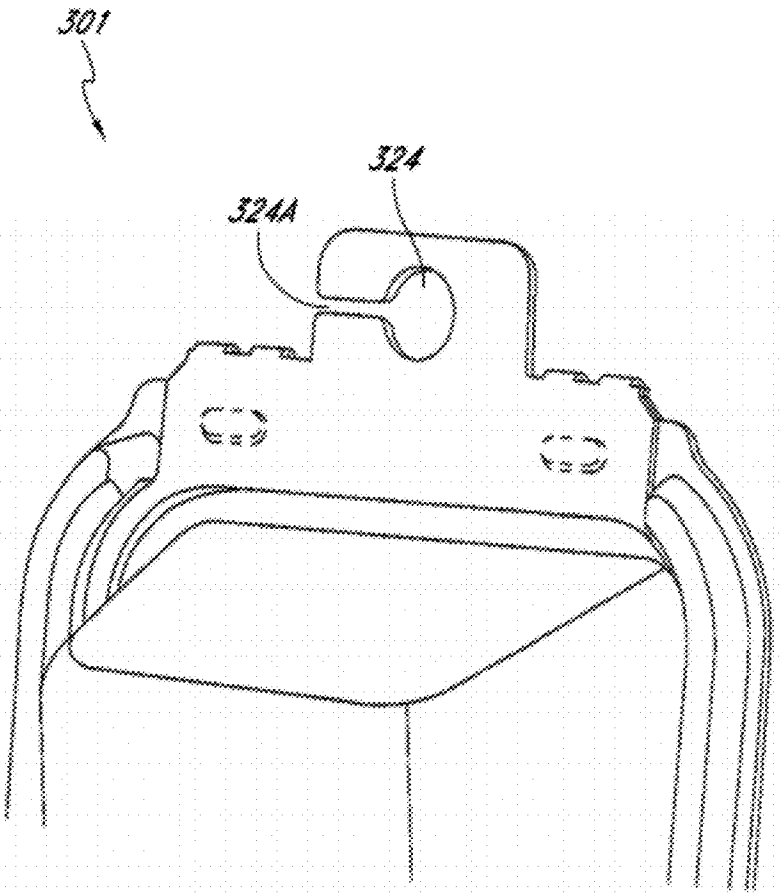
FIG. 5A is an isometric front view of another embodiment container system in a closed position.

FIGS. 5A, 5B depict another embodiment container system 301. This embodiment can be substantially similar to the embodiment container system 201 in FIGS. 4A-C. However, the container system 301 in FIGS. 5A-B can include a hanger hole 324 with a side opening 324A allowing the container system to engage a hanger from the side. Alternatively, the previous embodiments typically enter a hanger from an end.

Figure 6:
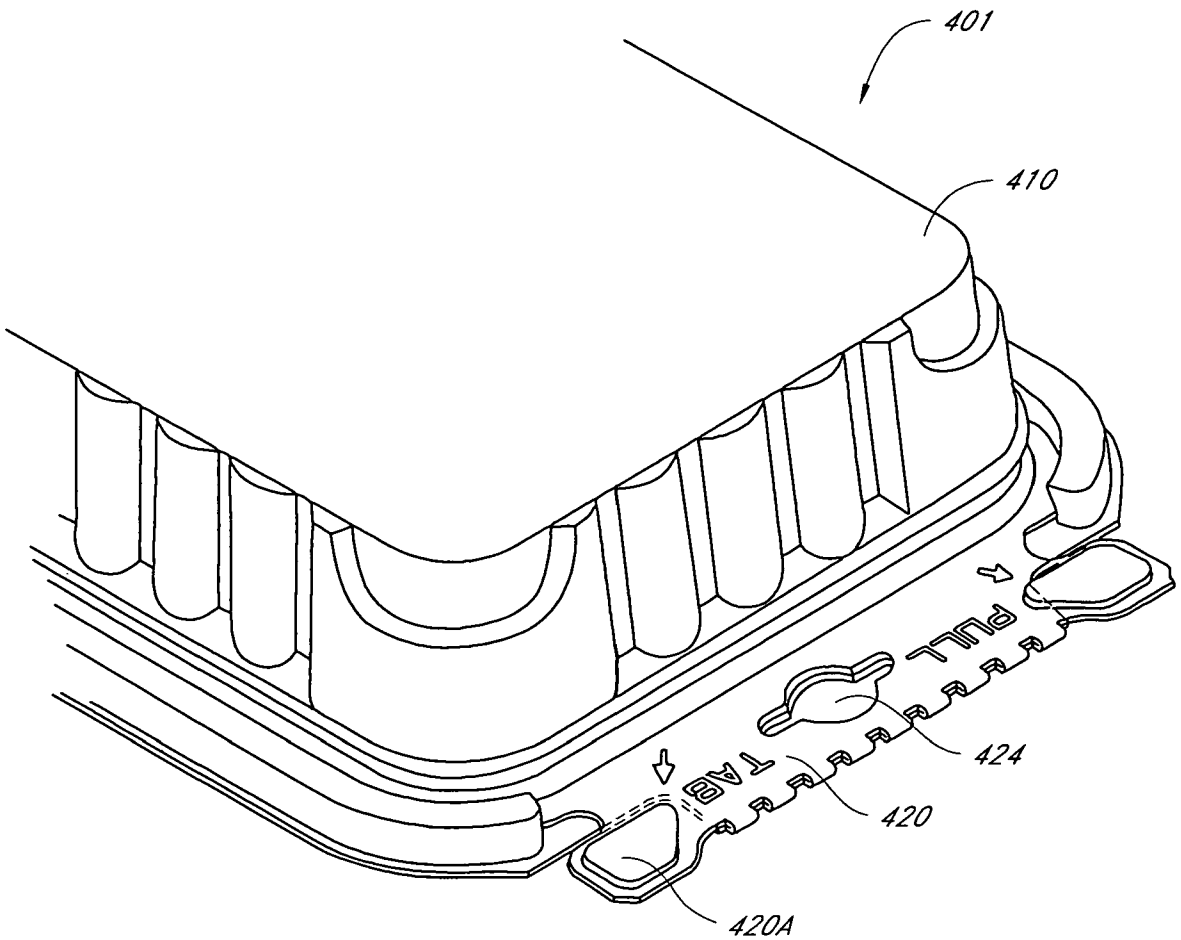
FIG. 6 is an isometric view of another embodiment container system in a closed position.
Figure 7:
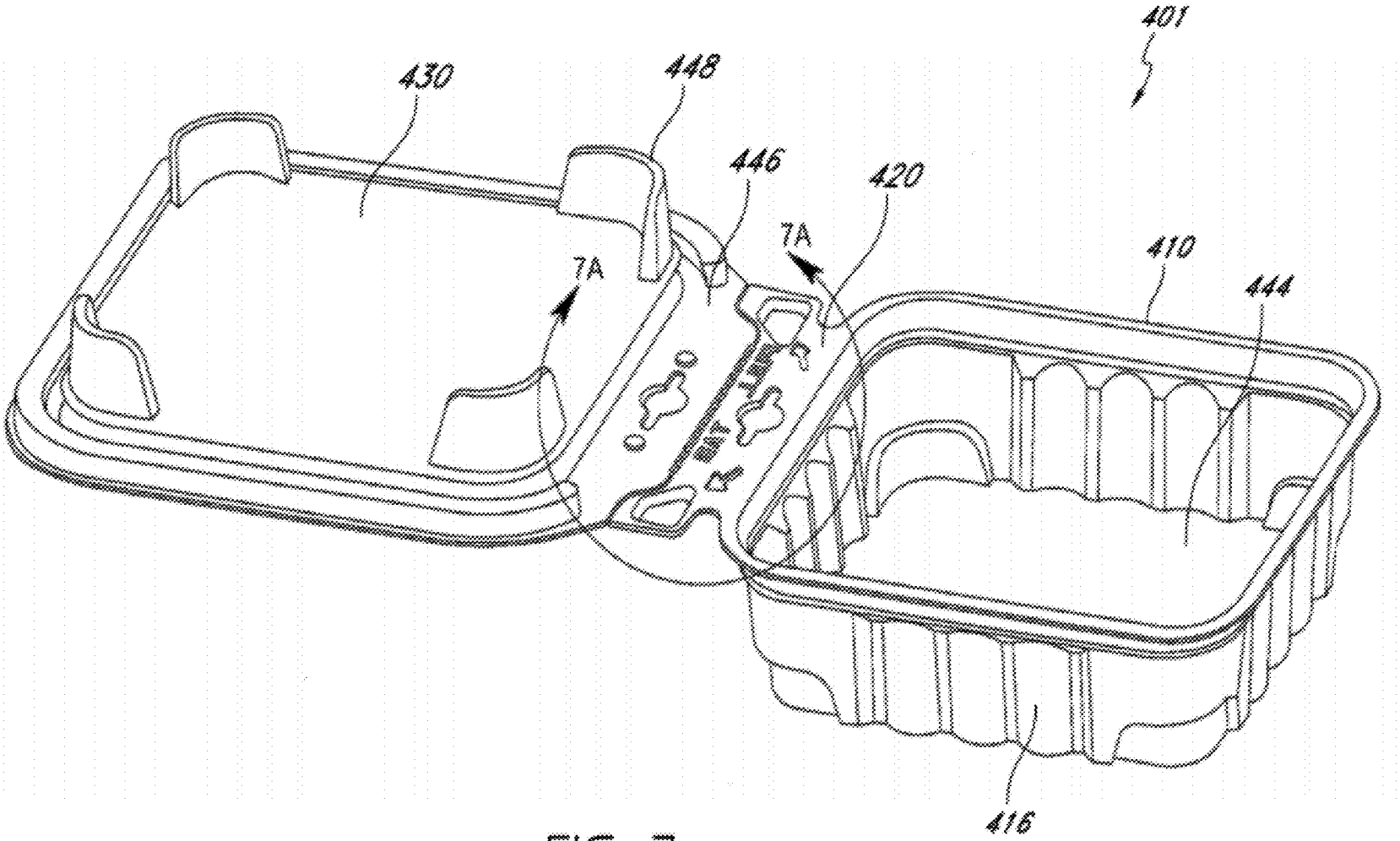
FIG. 7 is an isometric view of the container system of FIG. 6 in an open position.
Figure 7A:
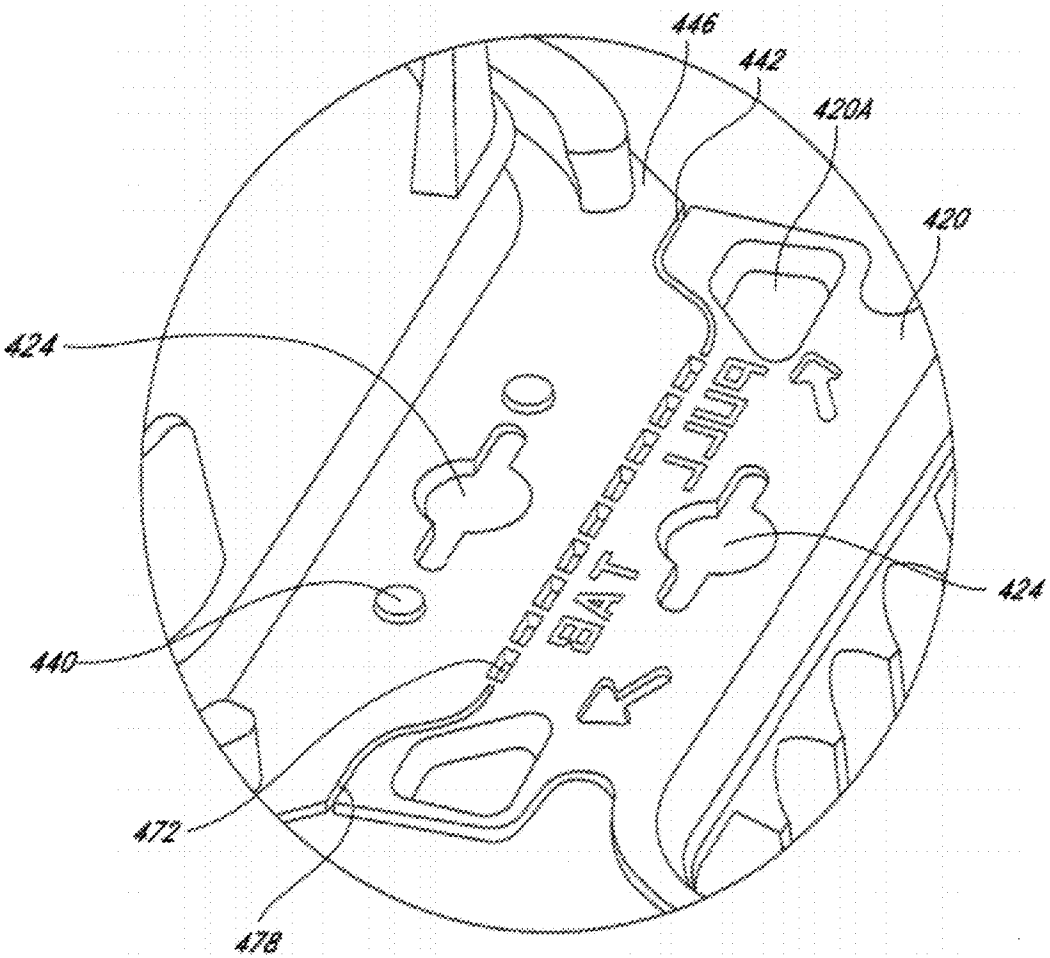
FIG. 7A is an enlarged view of the container system of FIG. 7 at 7A-7A.
Figure 8:
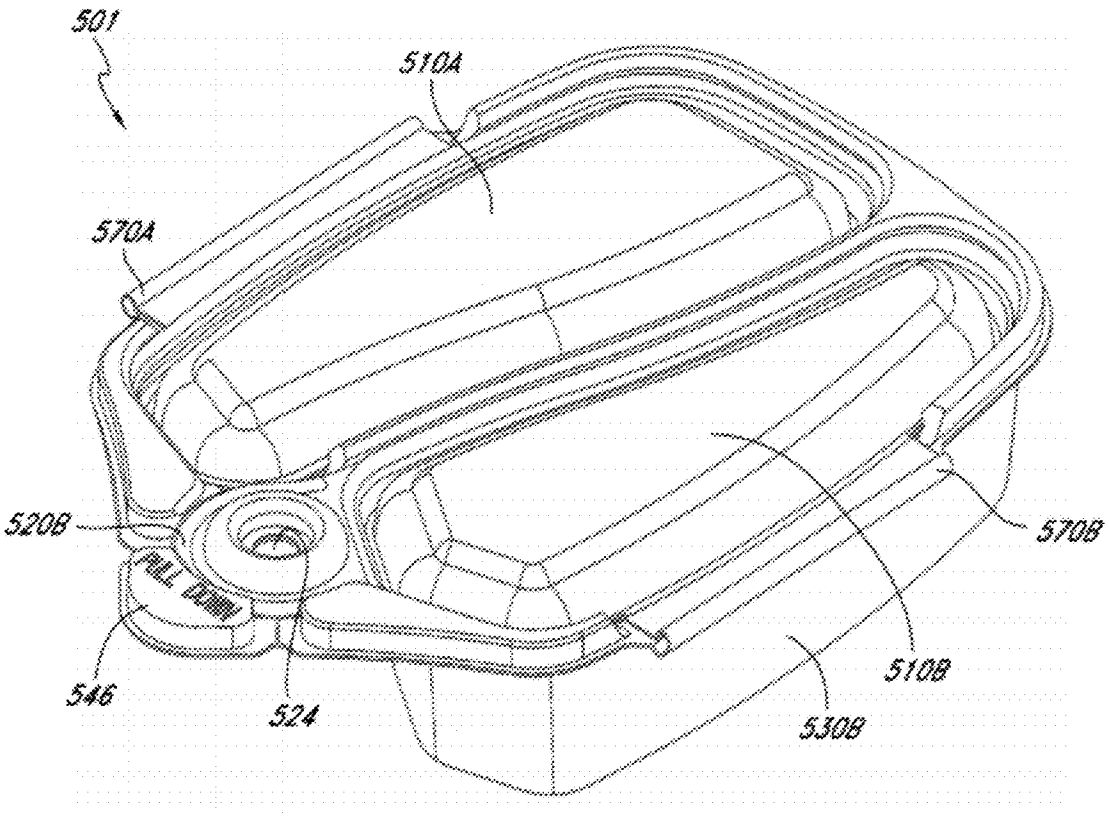
FIG. 8 is a perspective view of an embodiment dual-compartment container is a closed position.
Figure 9:
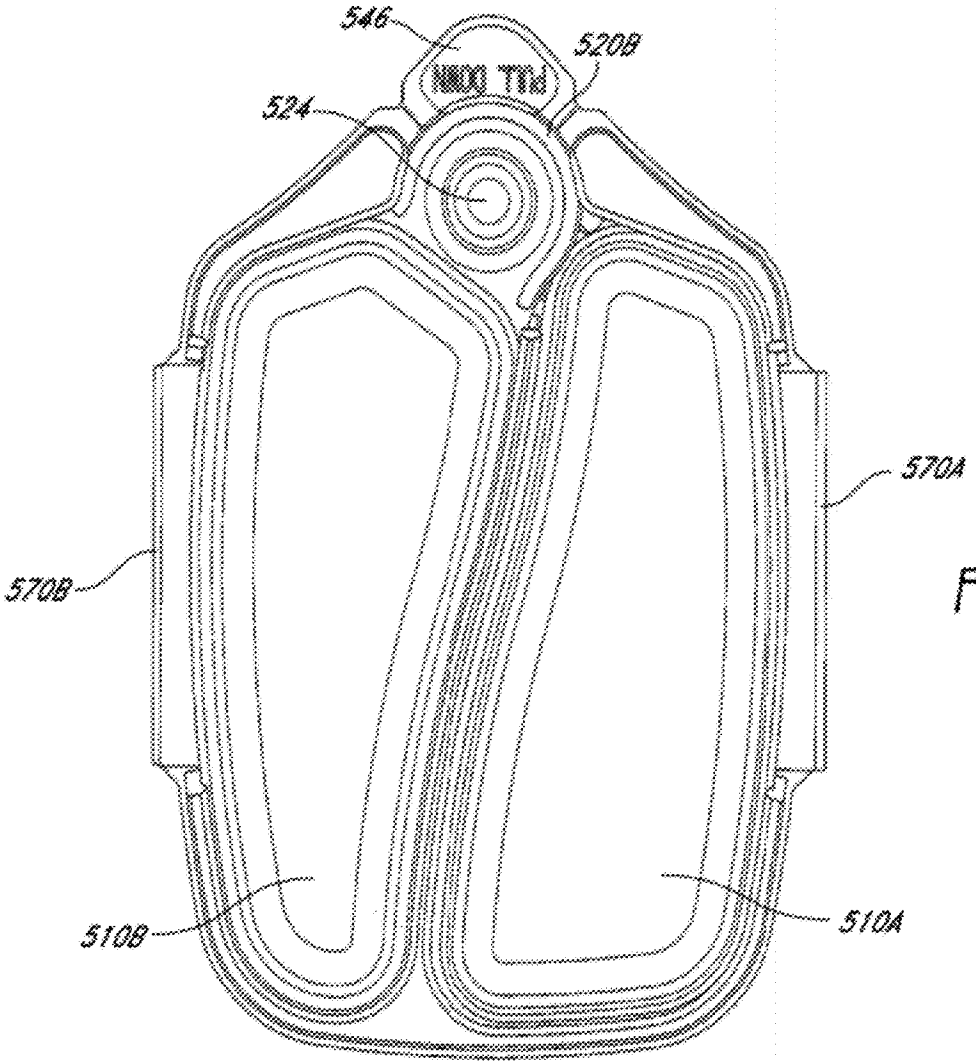
FIG. 9 is a top view of the container of FIG. 8.

FIGS. 6, 7, 7A depict another embodiment container system 401. The container system 401 can be substantially similar to the container systems described in the previous figures, including a lid 410 and a base 430. As depicted, the lid 410 includes a cavity 444, and the base includes projected walls 448. The projected walls 448 can advantageously be shaped to match the shape of an intended product held by the container system 401, and the side walls 416 on the lid 410 can be shaped to receive the corner walls 448. As further depicted, both the lid 410 and the base 430 can include hanger holes 424 on their respective tabs 420, 446. However, the entrance slit 478 can be extended and arculate, as compared to the previous embodiments. Accordingly, as depicted the entrance slits 478 can create side tabs 420A on the lid 410 that correspond with cutouts 442 on the base 430 and the outer edges of the container system 401. In opening the container system 401, a customer can pull the side tabs 420A to tear the join line 472. Then, the container system 1 can be easily opened by separating the tabs 420, 446.

FIGS. 8-14 depict another embodiment container system 501 that can be substantially similar to the previous embodiments. The container system 501 can comprise a dual-compartment design, including first and second lids 510A, 510B and first and second bases 530A, 530B. As shown, the bases 530A, 530B can be adjacent and joined, with hinges 570A, 570B on the sides. The first lid 501A can include a first lid tab 520A that can easily enter a base tab slot 545 when the first compartment is closed. The first compartment can then be held closed by a perimeter seal similar to those discussed above. The first compartment can be opened by pulling on the first lid tab 520A, which can be inaccessible from outside the container system 501, as further described below.

Figure 10:
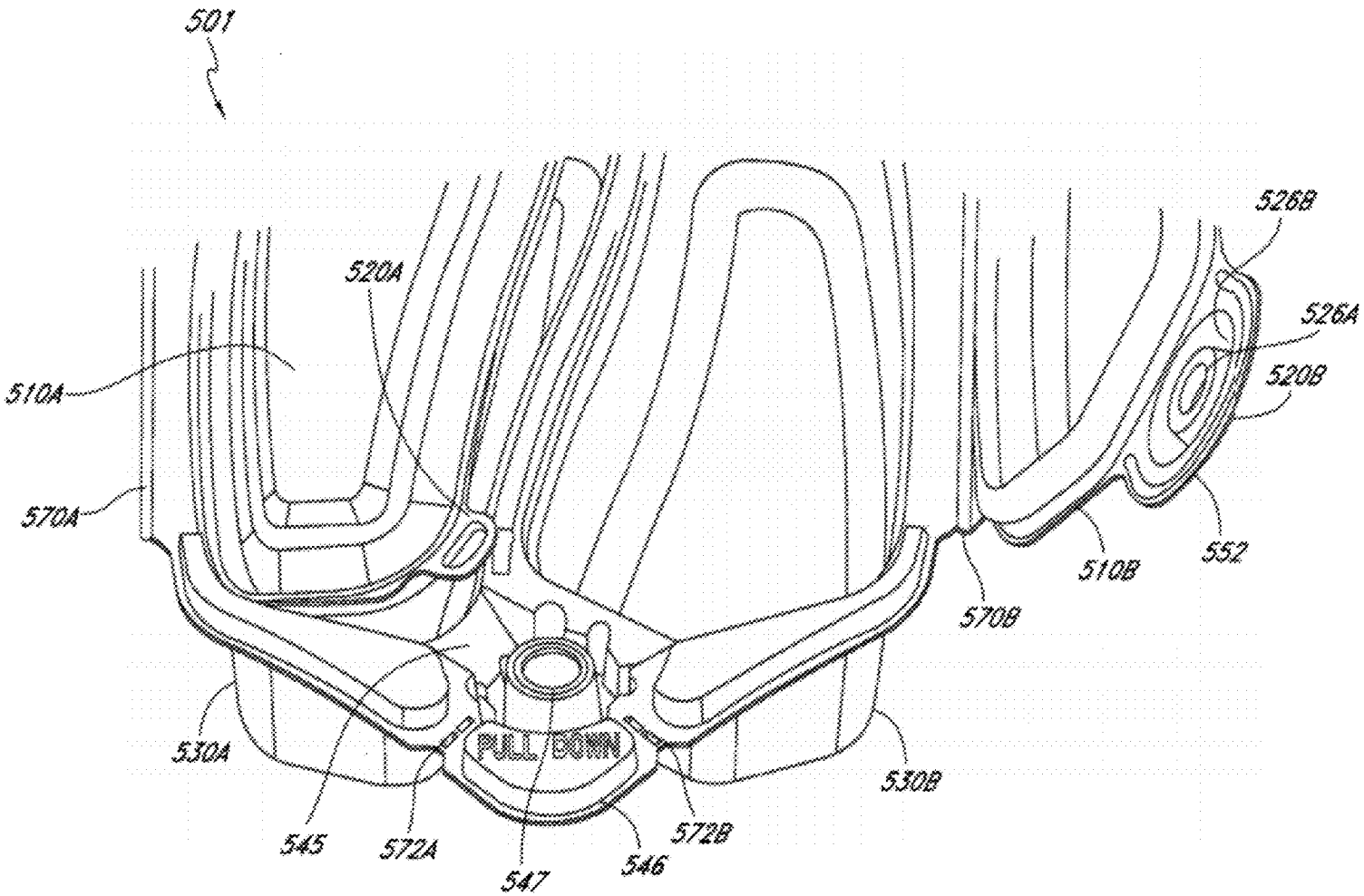
FIG. 10 is an enlarged view of an embodiment dual-compartment container in an open position.
Figure 11:
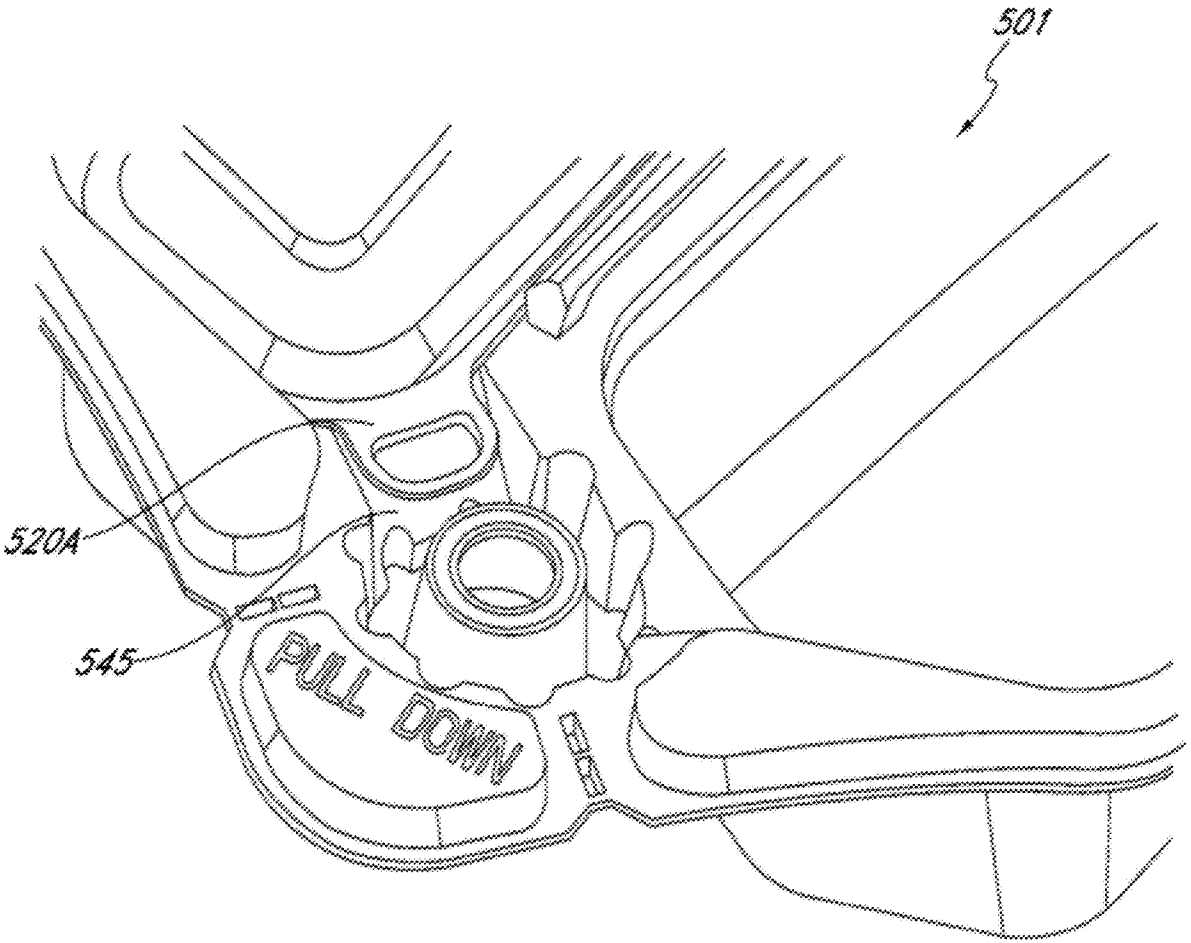
FIG. 11 is an enlarged view of the dual-compartment container of FIG. 8 in a half-closed position.
Figure 12:
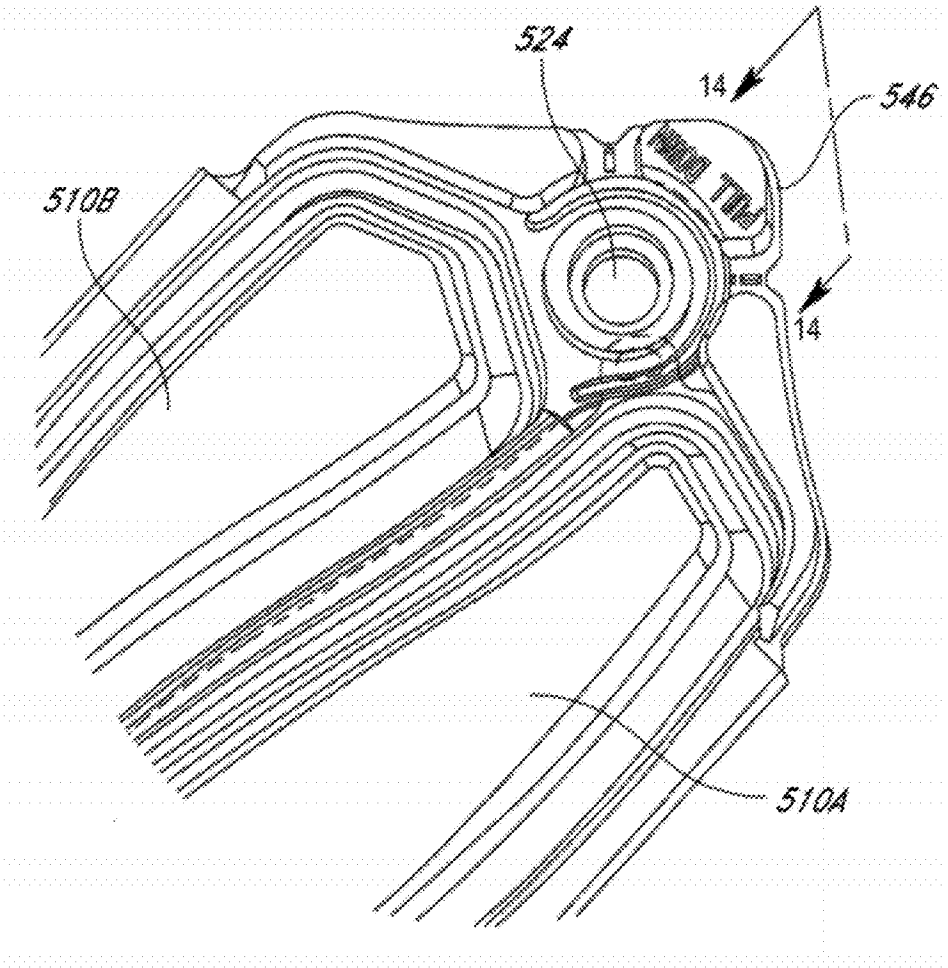
FIG. 12 is an enlarged view of the dual-compartment container of FIG. 8 in a closed position, with portions of a first lid tab shown in phantom.
Figure 13:
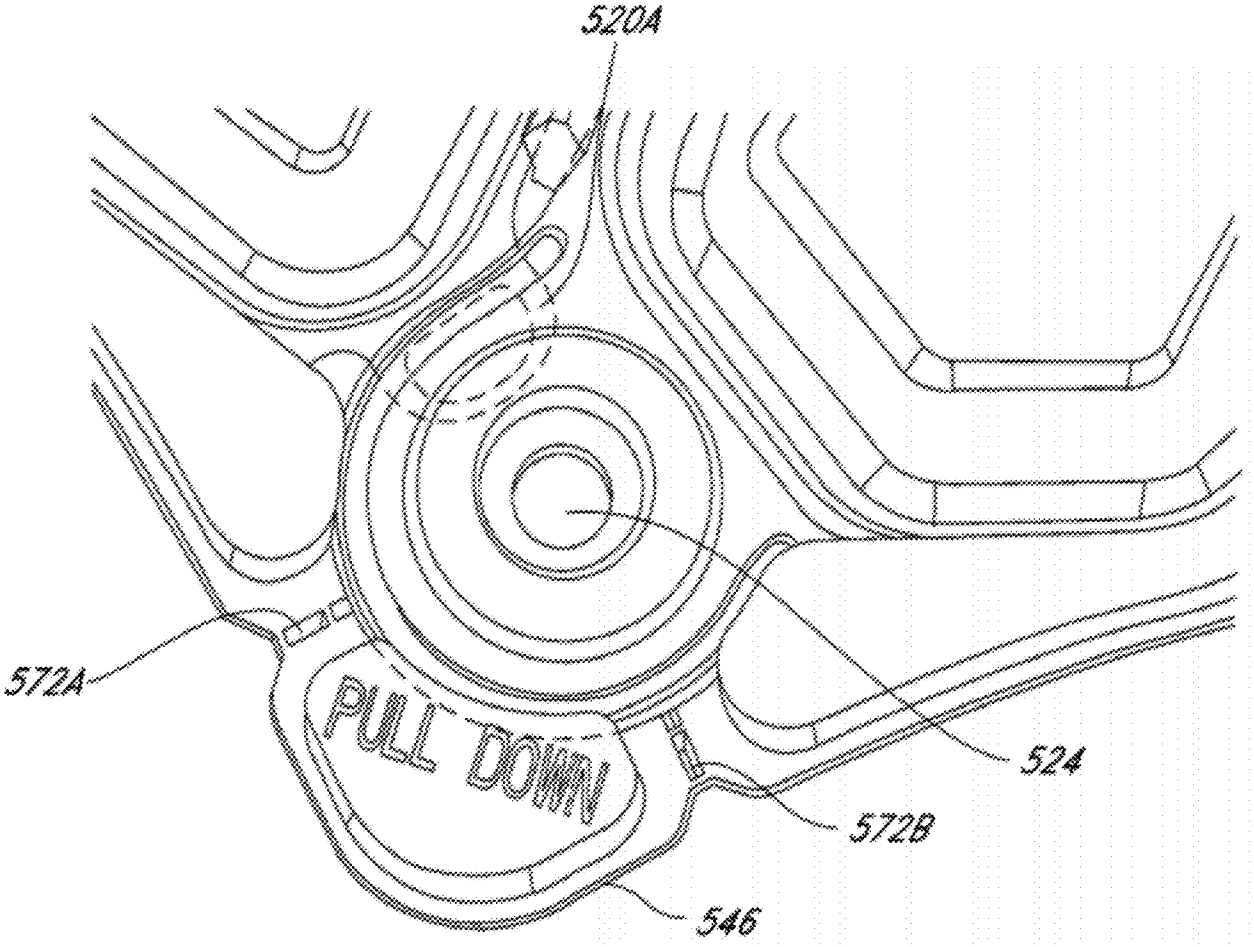
FIG. 13 is a further enlarged view of the dual-compartment container of FIG. 8, with portions of a first lid tab shown in phantom.
Figure 14:
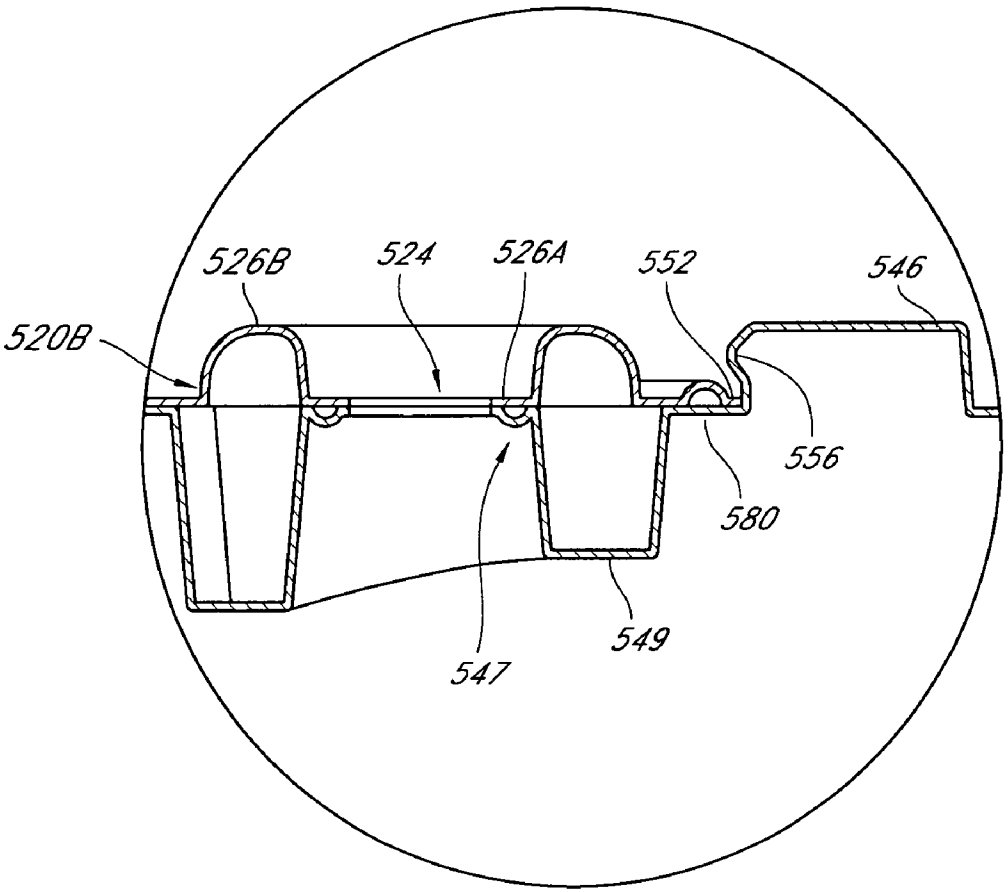
FIG. 14 is a cross-sectional view of the dual-compartment container of FIG. 12 at 14-14.

Still referring to the embodiments of FIGS. 8-12, FIG. 10 depicts the container system 501 near a half-closed position with the first compartment near a closed position and the second compartment in an open position. As shown in FIG. 11, the first lid tab 520A can be received entirely by the tab slot 545. Next, the second compartment can be closed, as the second lid 510B joins the second base 530B, entering the position depicted in FIGS. 8, 9, 12, 13. As best depicted in FIGS. 10, 14, the second lid 510B can include a lid tab 520B with an inwardly-facing circular groove 526B surrounding an inwardly-extending circular protrusion 526A. Further, the lid tab 520B on the second lid 510B can include a free end 552 extending substantially around the lid tab and including a c-shaped ridge. The second base 530B can include a base tab 546 connected to a circular protrusion 547 within a recessed generally circular groove 549. The circular protrusion 547 can include a free end with a c-shaped ridge, as shown. As depicted in FIGS. 12-14 the circular protrusion 547 on the second base 530B can engage the circular protrusion 526A on the second lid 510B, as can the join rim part 580 with the free rim 552 on the lid and analogous portions on the interior from the protrusions (on the left side of FIG. 14). Advantageously, these engagements can create a seal that compliments sealing features discussed above as extending around the remainder of the perimeter of the container system 501.

Figure 14A:
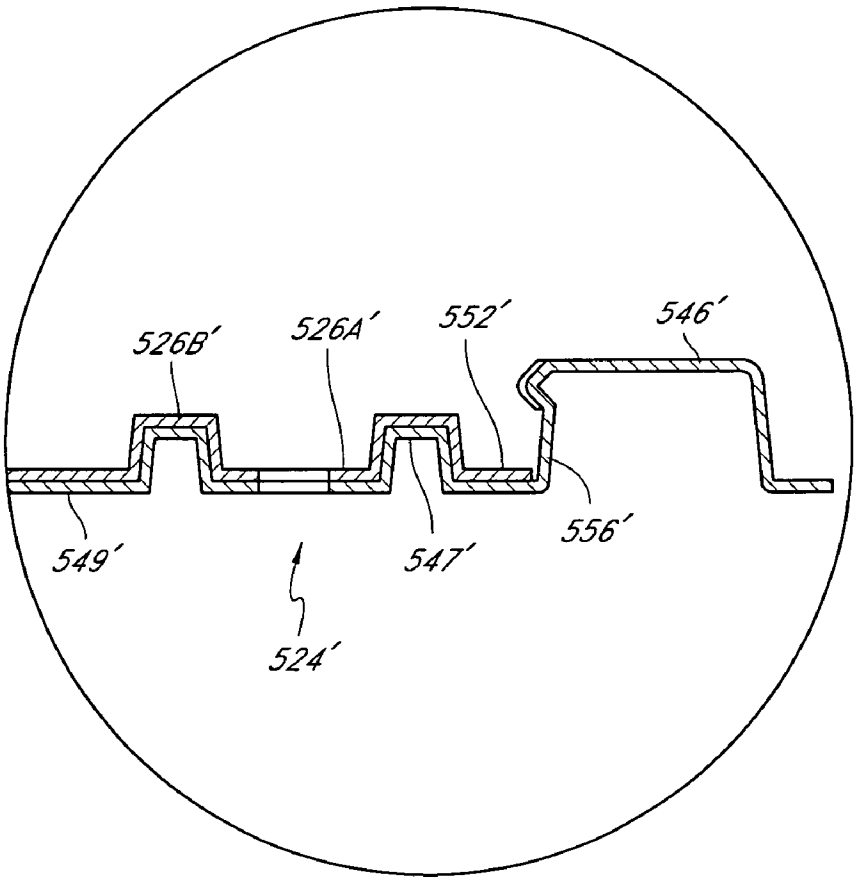
FIG. 14A is a cross-sectional view of the dual-compartment container of FIG. 12 at 14-14 with an alternative interengaging structure.

An alternative embodiment is depicted in FIG. 14A, with similar features to those of FIG. 14 denoted with a corresponding numeral. As shown, the second base 530B can include a circular protrusion 547' and a circular groove 549'. The circular protrusion 547' on the second base 530B can generally match the circular groove 526B' on the second lid 510B, creating a substantial seal between the two. Further, the circular groove 549' on the second base 530B can generally match the free rim 552' of the second lid 510B, substantially creating a second sealing portion.

Upon closing the second compartment of the container system 501, a hanger hole 524 can be formed, passing through the circular protrusions and groove 526A, 526B, 547 on the second lid and base 510B, 530B. Additionally, as best depicted in FIG. 13, closing the second compartment can conceal the first lid tab 520A, preventing opening of the first compartment.

In both embodiments (FIGS. 14, 14A), the free rim 552 of the second lid 510B can engage an undercut 556 on the base tab 546. Referring back to FIG. 10, the base tab 546 can include two join lines 527A, 527B extending inward toward the circular protrusion 547. To release the second lid 510B from the second base 530B a customer can pull the base tab 546, simultaneously causing the join lines 572A, 572B to break and the free rim 552 to release from the undercut 546, as in the previously described embodiments. Once the second compartment has opened, the first lid tab 520A is accessible and can be lifted to open the first compartment.

FIGS. 15-18A depict another embodiment container system 601, substantially similar to the embodiments discussed above, especially the embodiment container system 1 depicted in FIGS. 1-3. As depicted, the container system 601 can be another dual compartment container system. As shown, the two bases 630 can be connected by a compartment hinge 690 on a lateral side, and to their respective lids 610 on a longitudinal side. As depicted, the lids 610 are not joined, allowing them to be opened and closed independently. Further, one of the two bases 630 can include a base tab 646 with a hanger hole. Although the container system 601 is primarily depicted as having only one base tab 646 at a longitudinal end, additional base tabs can be provided, as shown in phantom on a second, complimentary longitudinal end and/or on a lateral end. The lids 610 can each include an S curve 628 separating two portions of the lid 610 at different heights, creating an S-shaped ridge. As further depicted in FIG. 18A, the S curves 628 can have undercuts 629 which can form an interfering snap-fit interconnection when the lids 610 are face-to-face, as discussed below.

Figure 15:
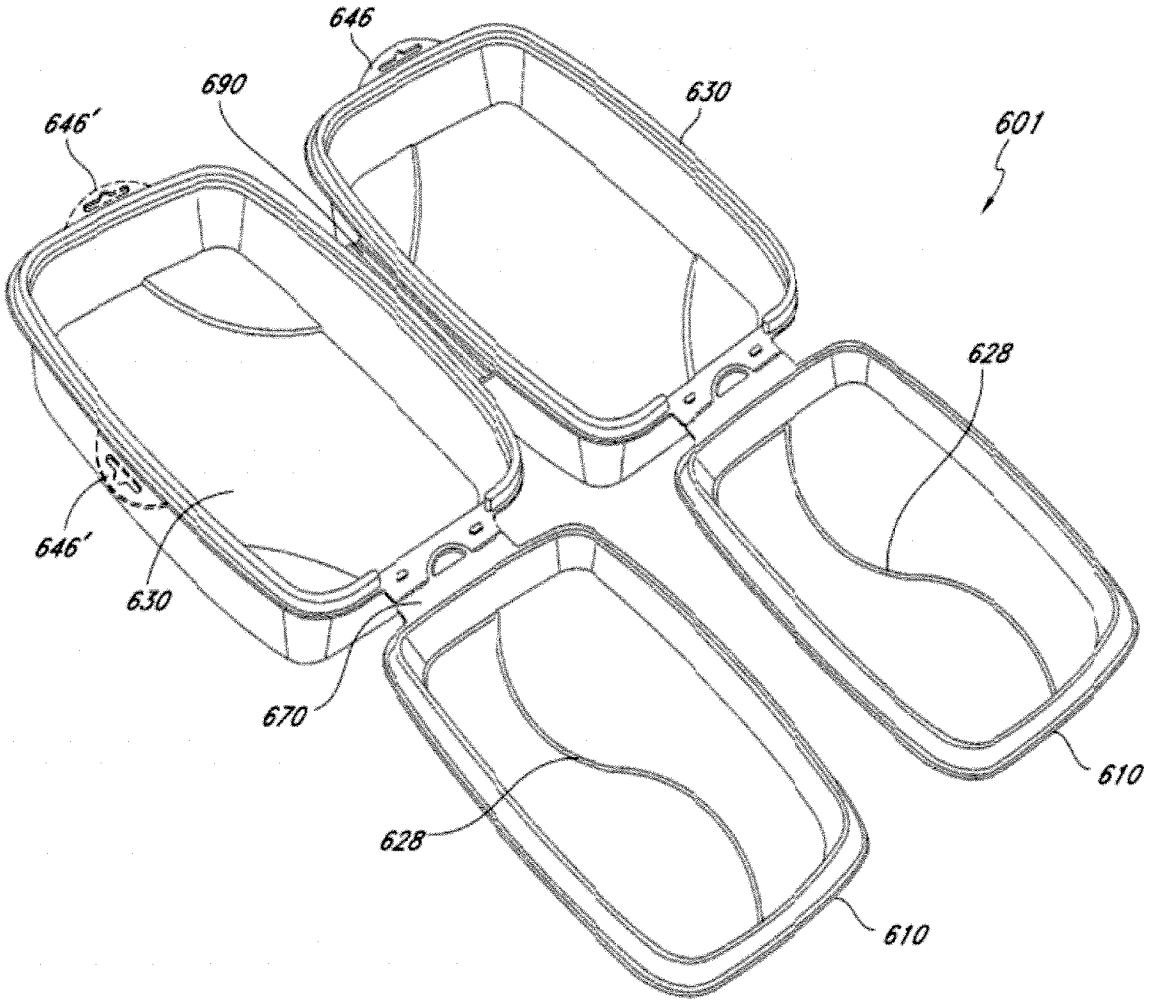
FIG. 15 is an isometric view of another embodiment container system in an open, unsealed position, with additional tabs shown in phantom.
Figure 16:
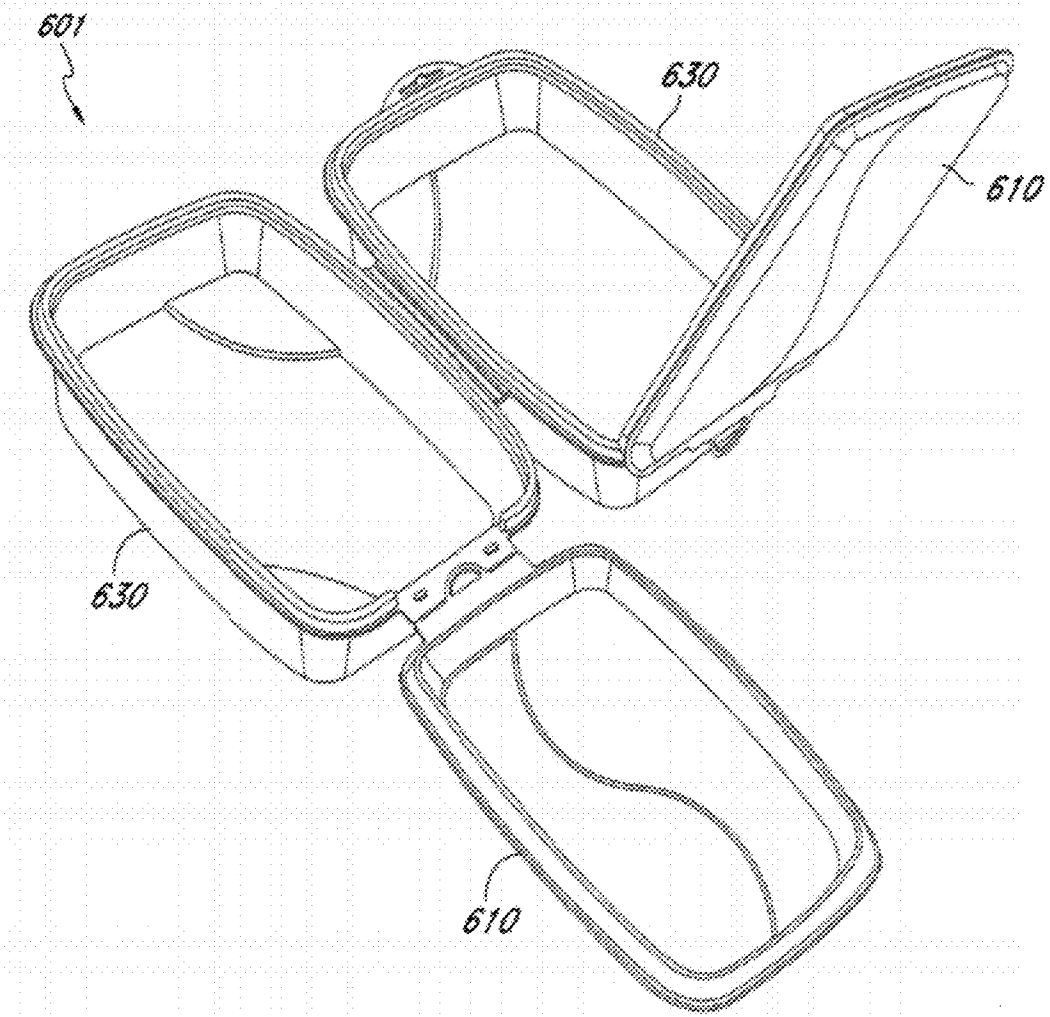
FIG. 16 is an isometric view of the container system of FIG. 15, with one half of the container system in an open, unsealed position with one lid portion raised.
Figure 17:
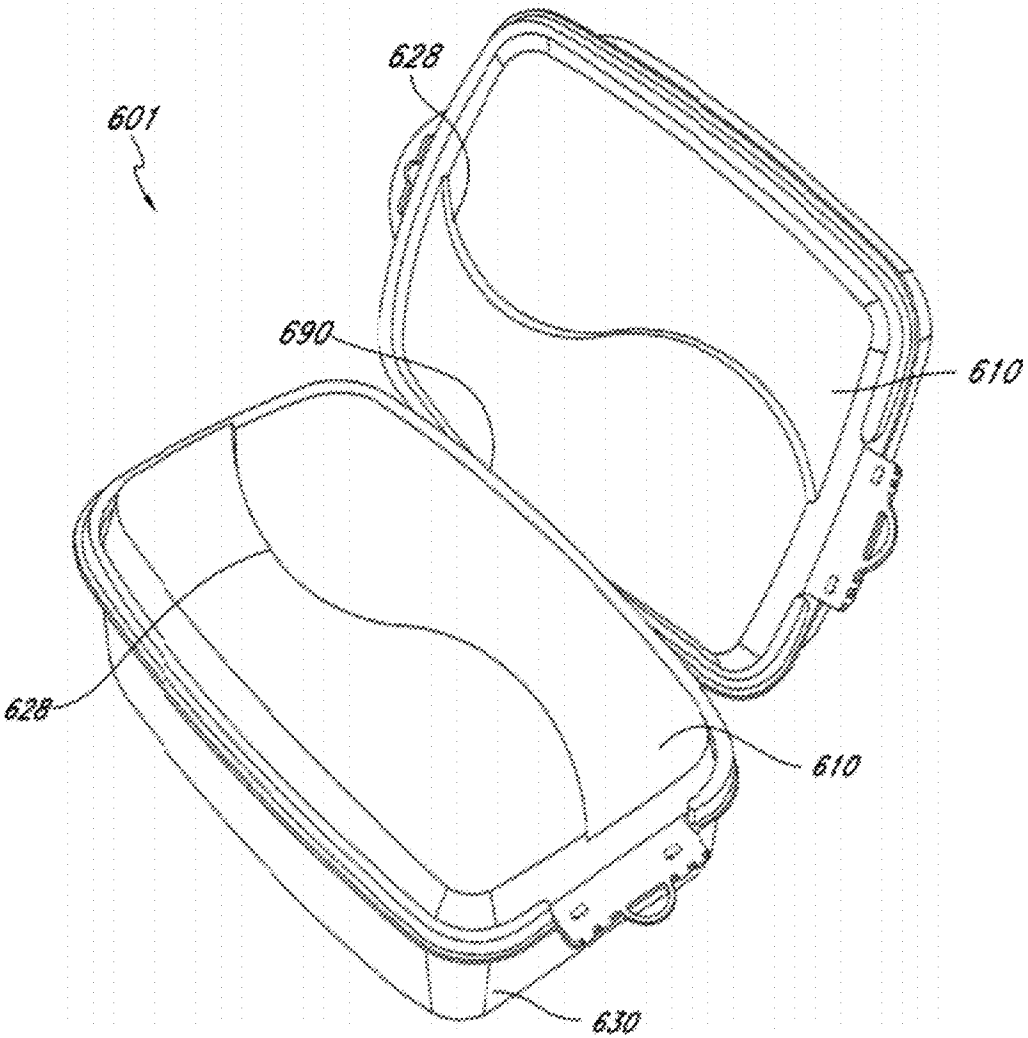
FIG. 17 is an isometric view of the container system of FIG. 15 in an open, sealed position.
Figure 18A:
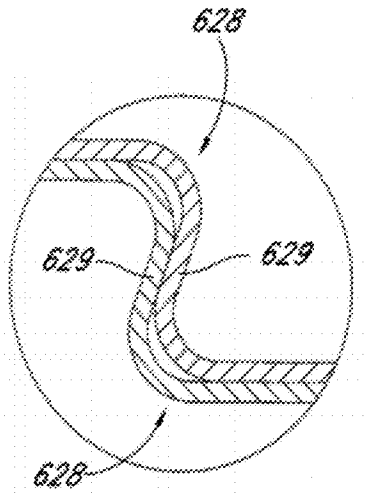
FIG. 18A is a cross-sectional view of the container system of FIG. 15 in a closed, sealed position as depicted in FIG. 18.
Figure 18:
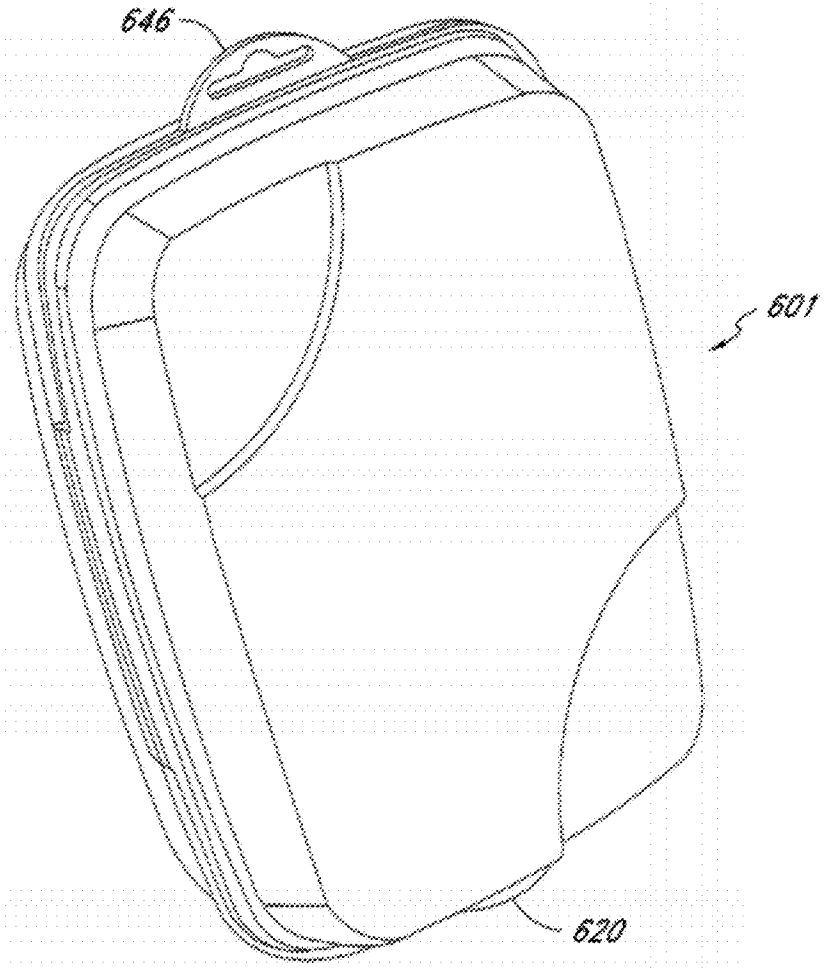
FIG. 18 is an isometric view of the container system of FIG. 15 in a closed, sealed position.

As depicted in FIGS. 15-18A, the container system 601 can be closed into a fully compact position. In FIG. 15, the container system 601 is in a fully open position, from which it can be loaded with product. As depicted in FIG. 14, the lids 610 can be closed independently. Once both lids 610 are in the closed position, the two bases 630 can rotate along the compartment hinge 690, as shown in FIG. 17, to a fully compact position depicted in FIG. 18. Advantageously, the S curves 628 on the lids 610 can interact in the contact position to further stabilize the container system 601, as their respective ridges and undercuts 629 snap-fit together. Providing further advantage, the compact container system 601 can be hung on either side, through the base tab 646 or the now-aligned lid tabs 620. Alternatively, the container system 601 can be hung in a non-compact position, with the two lid tabs 620 acting separately to hang the container, spreading the container's weight.

The container can be formed from a wide variety of polymers, including polystyrene, polypropylene, polyethylene terephthate, etc. Instead of a container of primarily rectangular shape as illustrated in a plan view, the container may be circular, elliptical, or of any reasonable polygonal shape. The base (and cover) can have walls forming compartments, and the container can include a middle tray.

Thus, the invention provides a container comprising a base and lid that can be constructed at low cost, that can be shipped to a store with its cavity open to enable easy loading of food or other goods by a store clerk, and that can be easily closed by the store clerk. The base and lid are preferably formed of a single sheet of plastic, and are joined by a join line that can be torn. After initial closing by the store clerk, the container strongly resists initial opening, to greatly discourage customers from secretly opening the container as to taste food in it. Instead, initial opening requires forceful opening by lifting a tab on the lid to tear the plastic sheet along the join line. Once the container has been initially opened, the fact that it has been initially opened is evident to anyone who looks at the container, which assures buyers that the container is intact. The container thereafter can be easily opened and closed. The plastic sheet that forms the container has a crease along the tear line, and has a narrow slit leading to the tear line. The lid tab extends axially outward beyond the join line by leaving a cutout when it is formed in the plastic sheet.

However, it should be understood that the invention described herein should not be limited to the embodiments described herein. For example, in some embodiments the container systems can be used outside the context of a store clerk or a customer. For example, the packaging can be loaded and sealed at a manufacturing plant, prior to delivery to a store. Alternatively, the packaging can be intended for a co-worker instead of a customer.

Further, although the embodiments described herein generally include a perforated join line that breaks upon opening the packaging, in some embodiments this feature can be absent. For example, in some embodiments it may be desirable to retain a hinging relationship between the lid and base of a container system, and thus the hinge would desirably not tear. However, the tearable join line can provide certain advantages, such as indicating that a container has previously been opened and the contents have potentially been contaminated.

Further variations on the described embodiments are also possible, such as alterations to the shape. It will be clear from the disclosure described herein that although most of the described embodiments are rectangular, other shapes are possible. As another example, the S shapes in the embodiment of FIGS. 13-16 can be substituted with another interlocking shape, such as a Z-shape or a 90-degree step.

Further, although the described embodiments are generally described in the context of deli containers, other contained consumer items are applicable. For example, in some embodiments the container systems can hold vegetables, nuts, candy, medical accessories, etc.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A clam-shell container system comprising:

a first container piece comprising a perimeter and a hangable tab with an opening configured to receive a rod; and a second container piece comprising:

a hinge connection with the first container piece, the hinge connection being perforated such that the hinge connection breaks upon actuation of the hangable tab to open the container system;

a cutout in proximity to the hinge connection and the hangable tab providing clearance for the rotation of the hangable tab beyond the hinge connection; and a perimeter having a shape substantially similar to the perimeter of the first container piece and configured to form a substantial seal with the perimeter of the first container piece.

2. The container system of claim 1, wherein the first container piece further comprises a cavity.

3. The container system of claim 1, wherein the second container piece further comprises a cavity.

4. The container system of claim 1, wherein the hinge connection forms one end of the tab.

5. The container system of claim 1, wherein the perimeters combine to form an interlocking means.

6. The container system of claim 1, wherein the lift tab comprises a rigid polymer selected from the group consisting of polystyrene ("PS"), polypropylene ("PP"), polyethylene terephthalate ("PET"), amorphous PET ("APET"), crystallized PET ("CPET"), oriented polystyrene ("OPS"), talc-filled polypropylene ("TFPP"), and polyactic acid ("PLA").

7. The container system of claim 1, wherein the lift tab is no greater than 0.14 inches thick.

8. The container system of claim 1, wherein one of the first and second container pieces comprises one or more projected walls that generally match the shape of an intended product and the other container piece comprises a cavity.

9. The container system of claim 1, wherein the perforated hinge connection comprises a first tear line and the second container piece comprises a second tear line parallel to the first tear line, the hangable tab being between the cutout and one of the tear lines.

10. The container system of claim 1, wherein the hangable tab comprises a through hole.

11. A method for forming a container system comprising:

forming a thermoplastic sheet into a first container piece comprising a perimeter and a second container piece connected by a strip of material at their ends, the second piece comprising a perimeter having a shape substantially similar to the perimeter of the first container piece and configured to form a substantial seal with the perimeter of the first container piece;

cutting the strip to form a tab on the first container piece and a complementary cutout on the second container piece without removing material;

forming an opening in the tab of the first container piece, the tab being configured to receive a rod; and perforating the strip to form a perforated line from the edge of the strip to a base of the tab to form a hinge connection between the first container piece and the second container piece.

12. The method of claim 11, wherein the first container piece further comprises a cavity.

13. The method of claim 11, wherein the second container piece further comprises a cavity.

14. The method of claim 11, wherein the tab comprises a polygonal shape.

15. The method of claim 14, wherein the tab comprises a rectangular shape.

16. The method of claim 11, wherein the tab comprises a rounded shape.

17. The method of claim 16, wherein the tab comprises a semi-circular shape.

18. The method of claim 11, wherein the tab is formed from the cutout and an outer edge of the container system.

19. The method of claim 18, wherein the tab is formed from the cutout.

20. A dual-compartment container system comprising:

two lids, each comprising a hangable tab; and two bases, each comprising:

a hinge connection with the lid, the hinge connection being perforated such that the hinge connection breaks upon actuation of the hangable tab to open the compartments; and a cutout in proximity to the hinge connection and the hangable tab providing clearance for the rotation of the hangable tab beyond the hinge connection;

wherein the two bases are hingedly connected such that they can be folded into a face-to-face position.

21. The container system of claim 20, wherein the each lid comprises a ridge.

22. The container system of claim 21, wherein the ridges comprise undercuts, such that the ridges can form an interlocking means when face-to-face.

23. The container system of claim 20, wherein at least one of the bases further comprises a hangable tab on a side separate from the hangable connection.

24. The container system of claim 23, wherein the side is opposite the hangable connection.

* * * * *

UNITED STATES PATENT AND TRADEMARK OFFICE

CERTIFICATE OF CORRECTION

PATENT NO. : 8,251,249 B1
APPLICATION NO. : 12/371888
DATED : August 28, 2012
INVENTOR(S) : Terry Vovan It is certified that error appears in the above-identified patent and that said Letters Patent is hereby corrected as shown below:

At column 12, line 26:

"Claim 18," should read

-- Claim 11, --

Signed and Sealed this
Twenty-seventh Day of November, 2012

David J. Kappos

David J. Kappos
*Director of the United States Patent and Trademark Office*